US011192171B2

(12) United States Patent
Dugenne

(10) Patent No.: US 11,192,171 B2
(45) Date of Patent: Dec. 7, 2021

(54) PNEUMATIC RIVETER COMPRISING A LEVER AND AN UNLOCKING ASSEMBLY FOR INHIBITING OR ENABLING OPERATION OF THE LEVER

(71) Applicant: APEX BRANDS, INC., Apex, NC (US)

(72) Inventor: Christophe Dugenne, Ozoir-la-Ferriere (FR)

(73) Assignee: Apex Brands, Inc., Apex, NC (US)

( * ) Notice: Subject to any disclaimer, the term of this patent is extended or adjusted under 35 U.S.C. 154(b) by 405 days.

(21) Appl. No.: 16/098,626

(22) PCT Filed: May 2, 2017

(86) PCT No.: PCT/US2017/030488

§ 371 (c)(1),
(2) Date: Nov. 2, 2018

(87) PCT Pub. No.: WO2017/192473

PCT Pub. Date: Nov. 9, 2017

(65) Prior Publication Data

US 2019/0134700 A1 May 9, 2019

Related U.S. Application Data

(60) Provisional application No. 62/330,474, filed on May 2, 2016.

(51) Int. Cl.

| | |
|---|---|
| ***B21J 15/28*** | (2006.01) |
| ***B21J 15/10*** | (2006.01) |
| ***B21J 15/18*** | (2006.01) |

(52) U.S. Cl.

CPC ..... *B21J 15/28* (2013.01); *B21J 15/105* (2013.01); *B21J 15/18* (2013.01)

(58) Field of Classification Search

CPC . B21J 15/00; B21J 15/28; B21J 15/105; B21J 15/18; B25B 27/02; B25B 31/00;

(Continued)

(56) References Cited

U.S. PATENT DOCUMENTS 2,355,520 A * 8/1944 Fischer ..... B21J 15/18 72/441
5,069,421 A * 12/1991 Kishi ..... B25F 5/00 251/99

(Continued)

FOREIGN PATENT DOCUMENTS

| | | |
|---|---|---|
| EP | 0117243 | 8/1984 |
| EP | 2565469 | 6/2013 |

(Continued)

OTHER PUBLICATIONS

International Search Report and Written Opinion of PCT/US2017/030488 dated Aug. 3, 2017, all enclosed pages cited.

(Continued)

*Primary Examiner* — Joseph J Hail
*Assistant Examiner* — J Stephen Taylor
(74) *Attorney, Agent, or Firm* — Burr & Forman, LLP

(57) ABSTRACT

A pneumatic riveter may include a jaw assembly (110) configured to extend around a portion of an object through which a fastener is to be driven, a lever (222) configured to be actuated to initiate rivet driving, a valve assembly portion (230) comprising a piston configured to enable progressive control of rivet driving responsive to actuation of the lever, and an unlocking assembly. The unlocking assembly may be configured to selectively inhibit operation of the lever responsive to positioning of a button (240) of the unlocking assembly in a locked position, and enable operation of the lever responsive to positioning of the button in an unlocked position.

20 Claims, 19 Drawing Sheets

(58) Field of Classification Search
CPC ..... B29C 65/56; B25D 17/04; B25D 17/043; B25D 11/00; B25D 11/02; Y10T 29/5377; F16B 19/04; B25F 5/005; B25F 5/02; F16P 3/18; F16P 3/22
USPC ..... 29/243.5, 243.521, 243.522, 243.523, 29/243.526, 243.53, 243.55, 243.56, 29/243.57, 243.58, 278, 276, 283.5
See application file for complete search history.

(56) References Cited

U.S. PATENT DOCUMENTS

| | | | | |
|---|---|---|---|---|
| 7,290,431 | B1 * | 11/2007 | Spivak | B21J 15/18 29/243.53 |
| 2006/0174466 | A1 | 8/2006 | Kato et al. | |

FOREIGN PATENT DOCUMENTS

| | | | | |
|---|---|---|---|---|
| FR | 3013999 | | 6/2015 | |
| FR | 3013999 | A1 * | 6/2015 | B21J 15/105 |

OTHER PUBLICATIONS

Office Action issued in corresponding Chinese application No. 201780040989.0 dated Nov. 4, 2019, all enclosed pages cited.
English translation of Office Action issued in corresponding Chinese application No. 201780040989.0 dated Nov. 4, 2019, all enclosed pages cited.

* cited by examiner

526

PNEUMATIC RIVETER COMPRISING A LEVER AND AN UNLOCKING ASSEMBLY FOR INHIBITING OR ENABLING OPERATION OF THE LEVER

CROSS REFERENCE TO RELATED APPLICATIONS

This application claims the benefit of U.S. Provisional Application No. 62/330,474 filed on May 2, 2016 the entire contents of which are hereby incorporated herein by reference.

TECHNICAL FIELD

Example embodiments generally relate to power tools and, in particular, relate to a riveter with a safety interlock and/or pneumatic valve assembly.

BACKGROUND

Power tools are commonly used across all aspects of industry and in the homes of consumers. Power tools are employed for multiple applications including, for example, drilling, tightening, sanding, component joining, and/or the like. For some component joining applications, riveters (e.g., rivet guns or other rivet setting tools) may be preferred. Riveters that are used in some applications may require operators to set a plurality of rivets in succession to joins surfaces or adjacent panels of, for example, an aircraft fuselage.

In such an environment, safety is paramount. Thus, safety interlocks may be provided to ensure that, for example, the operator does not accidentally actuate the riveter other than when specifically desired. However, if the safety interlock is required to be operated before each and every actuation of the riveter, the burden on the operator may be large and compliance may become a concern in cases where many rivets are typically set in series. In fact, in some cases, operators may permanently disable the safety interlock to avoid the burden.

To address this issue, a safety interlock that can ensure positive control of the tool and intent of the operator to set are confirmed before the riveter can actuate, but thereafter a series of actuations can be provided without overburdening the operator between such actuations.

BRIEF SUMMARY OF SOME EXAMPLES

Some example embodiments may enable the provision of a riveter that has a safety interlock that is secure (e.g., cannot be tampered with) and effective. Some example embodiments may also or alternatively provide for improved progressivity of actuation by providing an optimized pneumatic valve assembly.

A pneumatic riveter may include a jaw assembly configured to extend around a portion of an object through which a fastener is to be driven, a lever configured to be actuated to initiate rivet driving, a valve assembly portion comprising a piston configured to enable progressive control of rivet driving responsive to actuation of the lever, and an unlocking assembly. The unlocking assembly may be configured to selectively inhibit operation of the lever responsive to positioning of a button of the unlocking assembly in a locked position, and enable operation of the lever responsive to positioning of the button in an unlocked position.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

Figure 1A:
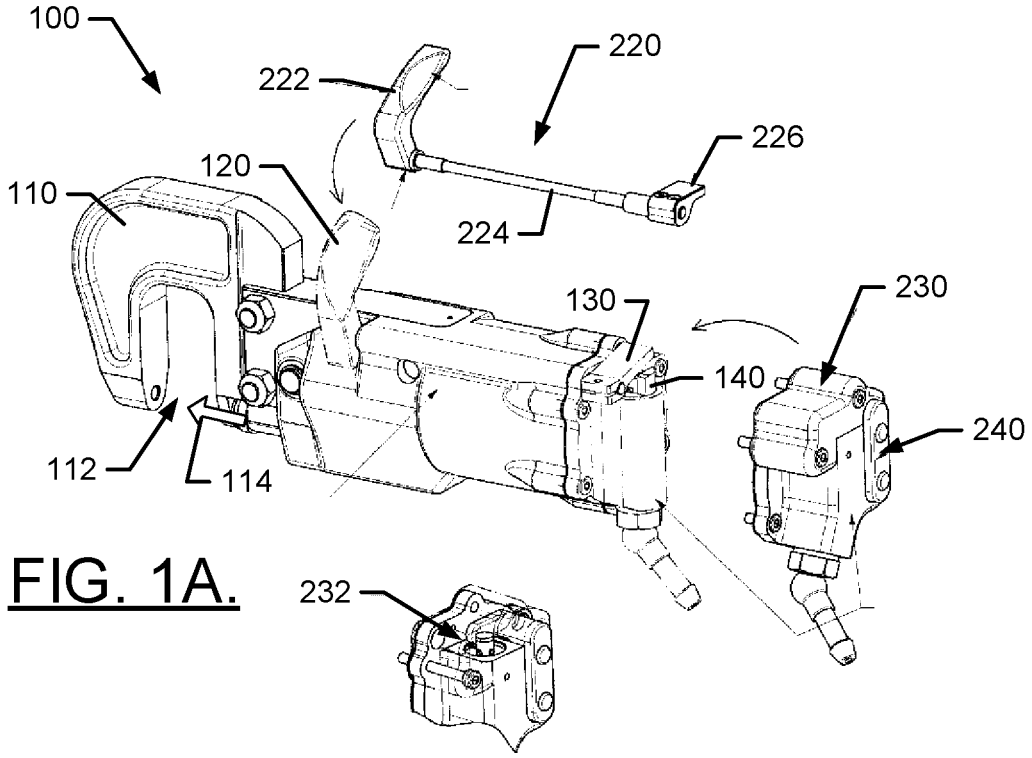
FIG. 1A illustrates a riveter having conventional components, and shows various modules that can replace some components of the riveter to improve the riveter according to an example embodiment.

FIG. 3, which includes FIGS. 3A, 3B, 3C, 3D, 3E, 3F, 3G, 3H and 3I, shows views of an example riveter with specific components highlighted or isolated to facilitate discussion of the operation of the riveter in accordance with an example embodiment;

FIG. 4, which includes FIGS. 4A, 4B, 4C, 4D, 4E, 4F, 4G, 4H, and 4I, shows views of an example riveter with specific components highlighted or isolated to facilitate discussion of the operation of the riveter in accordance with an example embodiment; and FIG. 5 which includes FIGS. 5A, 5B, 5C, 5D, 5E, 5F, 5G, 5H, 5I, 5J, 5K, and 5L, shows views of an example riveter with specific components highlighted or isolated to facilitate discussion of the operation of the riveter in accordance with an example embodiment.

DETAILED DESCRIPTION

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

As indicated above, some example embodiments may relate to the provision of a riveter that incorporates an improved safety interlock and an optimized pneumatic valve assembly. FIG. 1A illustrates a riveter 100 having conventional components, and shows various modules that can replace some components of the riveter to improve the riveter 100 according to an example embodiment.

Figure 1B:
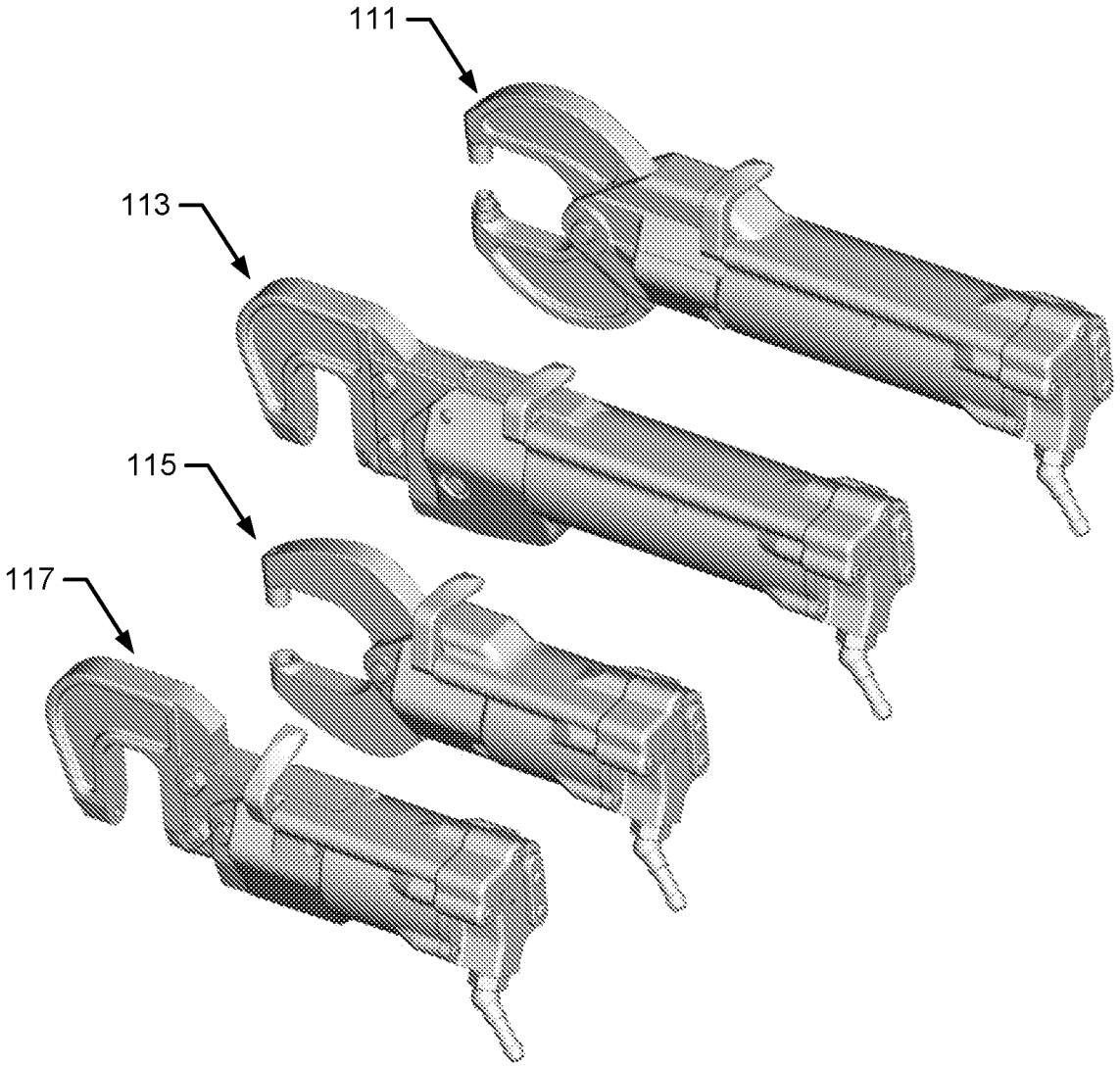
FIG. 1B illustrates different example riveters with corresponding different jaw assemblies.

As shown in FIG. 1A, the riveter 100 may include a jaw assembly 110. The jaw assembly 110 may extend to opposing sides of the component or components through which a rivet will be set or driven using the riveter 100. The jaw assembly 110 of FIG. 1A has a C-shaped mouth, but it should be appreciated that other example embodiments may employ an alligator-jaw mouth (with ends that are movable toward and away from each other), and jaw assemblies and riveters of different shapes and sizes are also possible. In this regard, FIG. 1B illustrates an alligator jaw assembly 111, a C-shaped jaw assembly 113, an alternative alligator jaw assembly 115, and an alternative C-shaped jaw assembly 117 according to various example embodiments. The mouth 112 of the jaw assembly 110 may have a component (or components) provided therein and a pneumatic power source of the riveter 100 may be used to drive a fastener, such as a rivet, in the direction of arrow 114.

The riveter 100 includes a lever 120 (or actuator) that is provided on the riveter 100 to be actuated by a hand or finger of the operator when the riveter 100 is under positive control and the operator intends to drive a rivet in the direction shown by arrow 114. The lever 120 may be rotatable about its mounting axis and, in some cases, may also be movable along the axis. Rotation about the mounting axis may be used to actuate the pneumatic power source of the riveter 100 to drive a rivet in the direction of arrow 114. The movement along the axis (e.g., in the direction of arrow 114) may be used to position a flange 130 provided at a rear end of the lever 120 so that the flange 130 is clear of a safety interlock tab 140. Prior to movement of the lever 120 along the axis, the safety interlock tab 140 may block rotation of the flange 130 (preventing actuation). However, after movement of the lever 120 forward along the axis, the safety interlock tab 140 may be no longer aligned with the flange 130 so that the flange 130 can rotate when the lever 120 is rotated about the axis. The flange 130 may, when rotated, encounter and actuate a piston of a pneumatic valve assembly 150 of the riveter 100.

This structure, although effective, requires the operator to make sure that the lever 120 is positioned so that the flange 130 is clear of the safety interlock tab 140 to permit actuation. However, the safety interlock tab 140 is exposed and could be broken off to prevent this safety interlock from properly operating. Accordingly, the riveter 100 may be alternatively designed to include a lever 220 of an example embodiment, and a valve assembly portion 230 that has an improved unlocking assembly 240 in accordance with an example embodiment. A piston 232 of the valve assembly portion 230 may be configured to have improved geometries and allow increased control over the stroke of the piston 232 responsive to the provision of pneumatic power based on the amount or speed of application of pressure on the lever 220.

Figure 2:
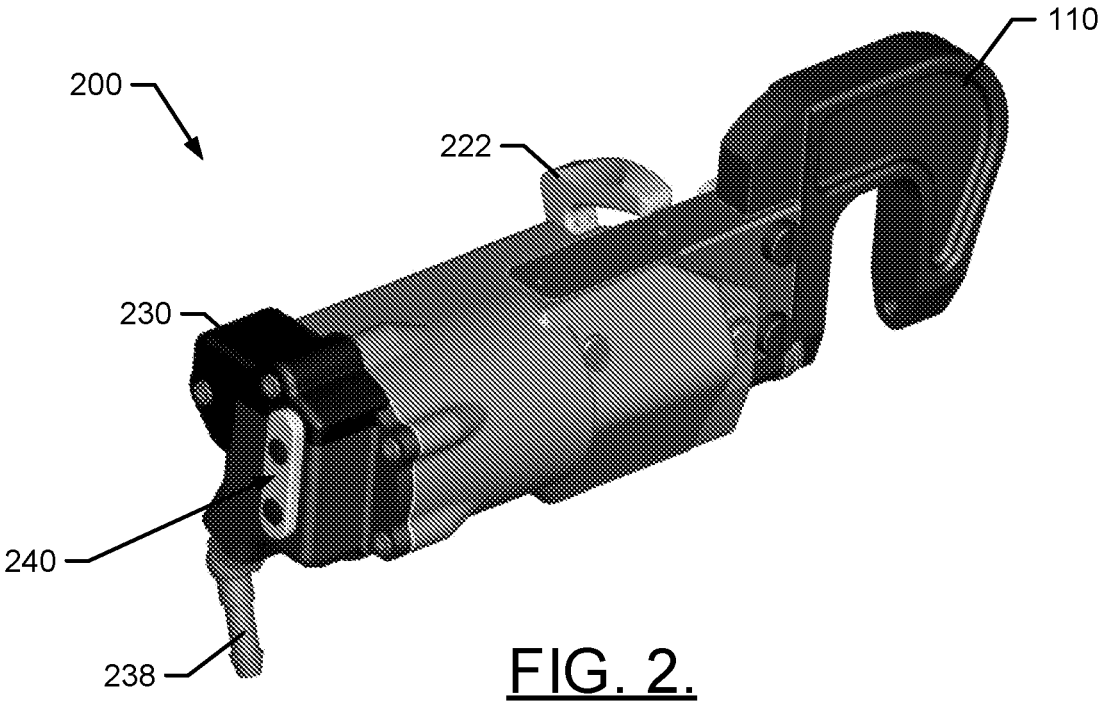
FIG. 2 illustrates a perspective view of a riveter having alternative components according to an example embodiment.
Figure 3A:
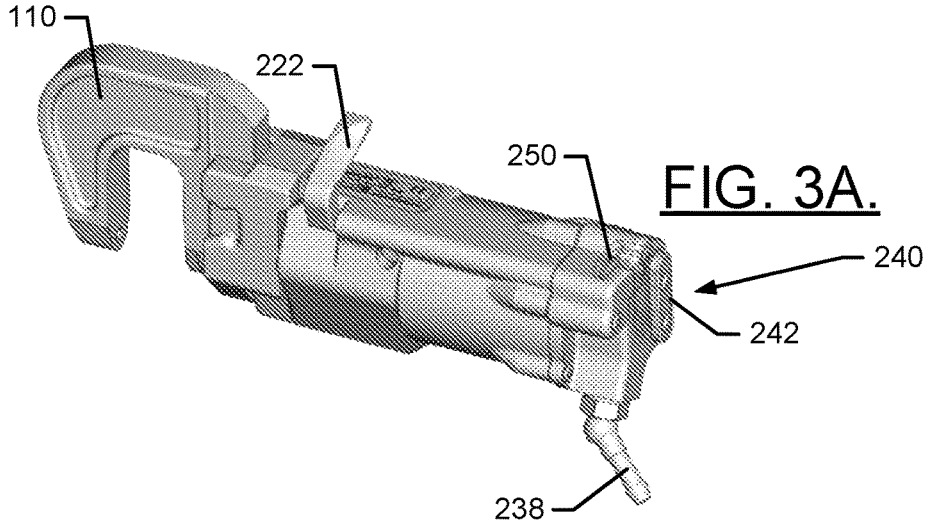

FIG. 2 illustrates a perspective view of a riveter 200 having the components introduced as alternative components above. FIG. 3, which includes FIGS. 3A, 3B, 3C, 3D, 3E, 3F, 3G, 3H and 3I, shows views of the riveter 200 with specific components highlighted or isolated to facilitate discussion of the operation of the riveter 200. Referring to FIGS. 1A-3I, it can be seen that the lever 220 includes an operator portion 222, a lever arm 224, and a flange 226. The operator portion 222 is provided at a front end of the lever arm 224 and the flange 226 is provided at a rear end of the lever arm 224. A longitudinal centerline of the lever arm 224 may define an axis about which the lever 220 rotates for actuation. In some embodiments, the lever arm 224 may be disposed within a shaft in the housing or body of the riveter 200. In this regard, when the lever 220 is actuated, the lever arm 224 may rotate (assuming such rotation is not prevented by a safety interlock) within the shaft and about the axis carrying the flange 226 to contact the piston 232 and displace the piston 232 downward. FIG. 3H shows a cross section view of the lever 220 so that the attachment of the flange 226 to the lever arm 224 can be seen in accordance with an example embodiment.

Figure 3B:
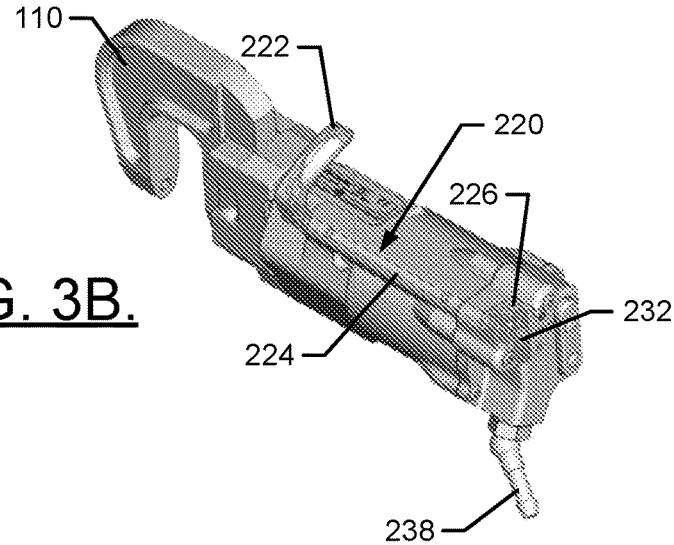

FIG. 3B highlights the lever 220 and each of its constituent parts in context. FIG. 3B also highlights the piston 232 in context, so the relationship between the lever 220 and the piston 232 can be appreciated within the riveter 200. As can be appreciated from FIG. 3B, and from FIGS. 1 and 2, downward displacement of the piston 232 may enable air from a pneumatic power source to pass through air line 238 to actuate the riveter 200 to drive a rivet. The piston 232 may be shaped to allow progressive control of the flow of air through cylinders of the riveter 200, so that better control of piston 232 position is possible. This may give the operator improved control of the stroke of the piston 232.

The unlocking assembly 240 may include an unlocking button, e.g. button 242. When the button 242 is in its rest position (or locked position), a blocking tab 250 may prevent the flange 226 from rotating to contact and displace the piston 232. The button 242 may be biased to the rest position by springs or other biasing members. In an example embodiment, one or more springs 243 may be provided around or between posts or screws 245 that connect the button 242 to a body or housing of the riveter 200. The springs 243, which are shown in the cross section view of FIG. 3G, may bias the button rearward or outward and the pressing of the button 242 by the user may overcome the force of the springs and reposition the blocking tab 250 accordingly.

Figure 3C:
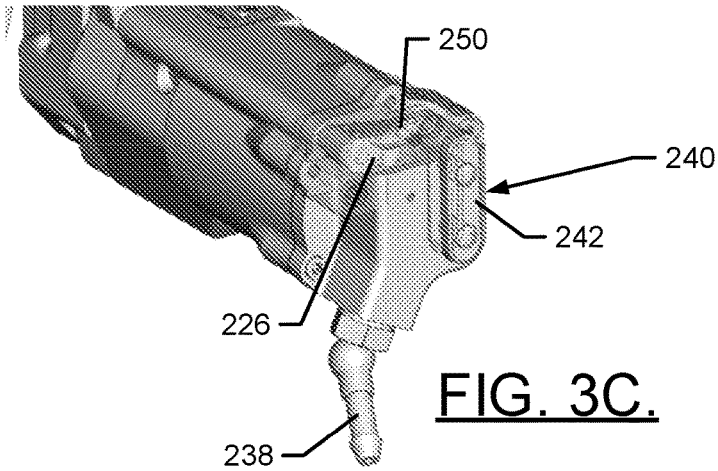
Figure 3D:
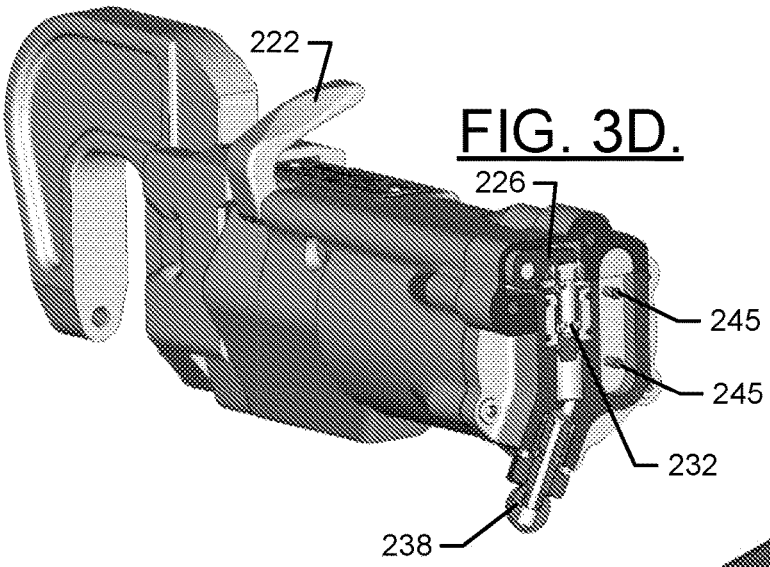
Figure 3E:
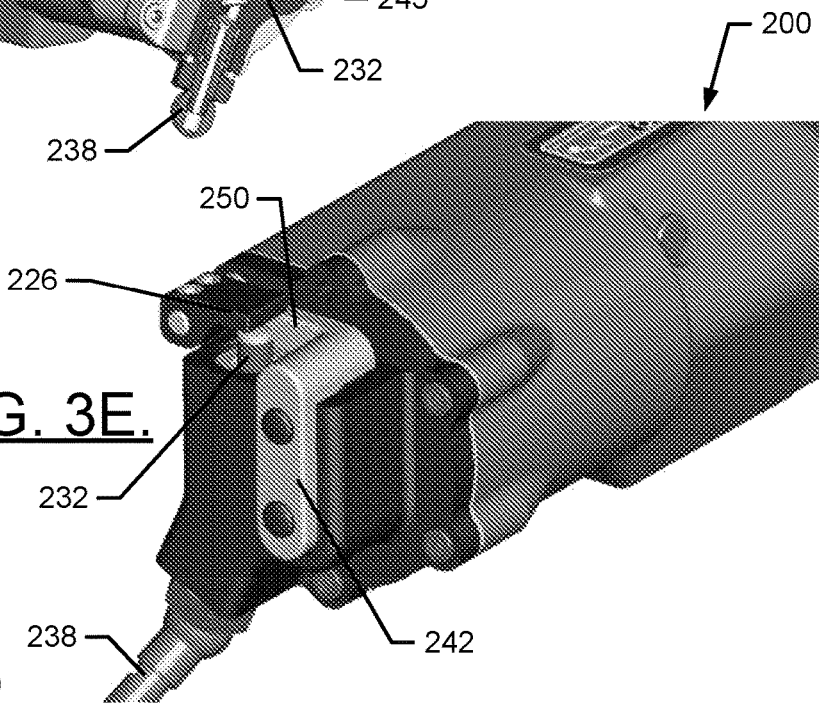
Figure 3F:
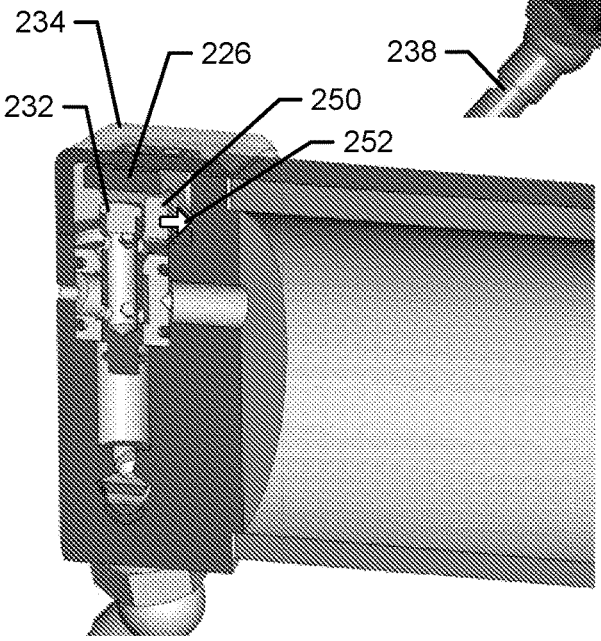
Figure 3G:
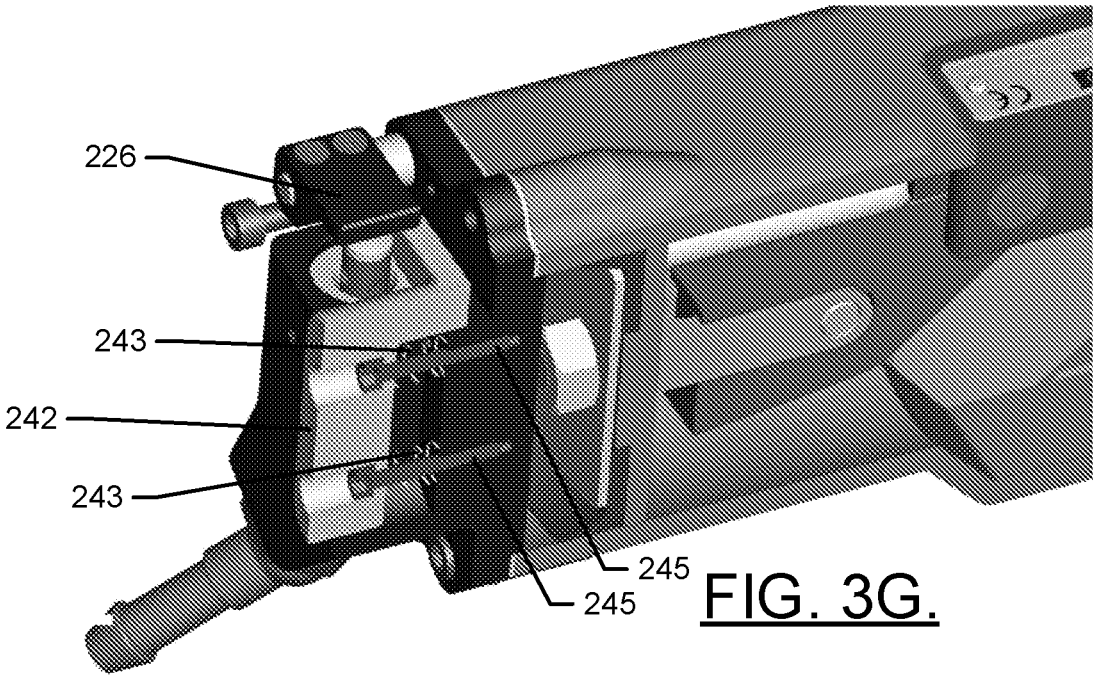
Figure 3H:
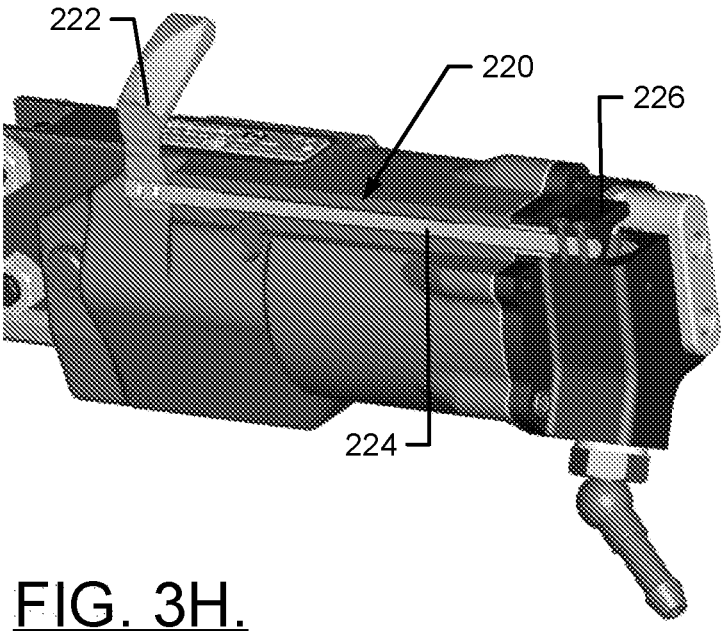
Figure 3I:
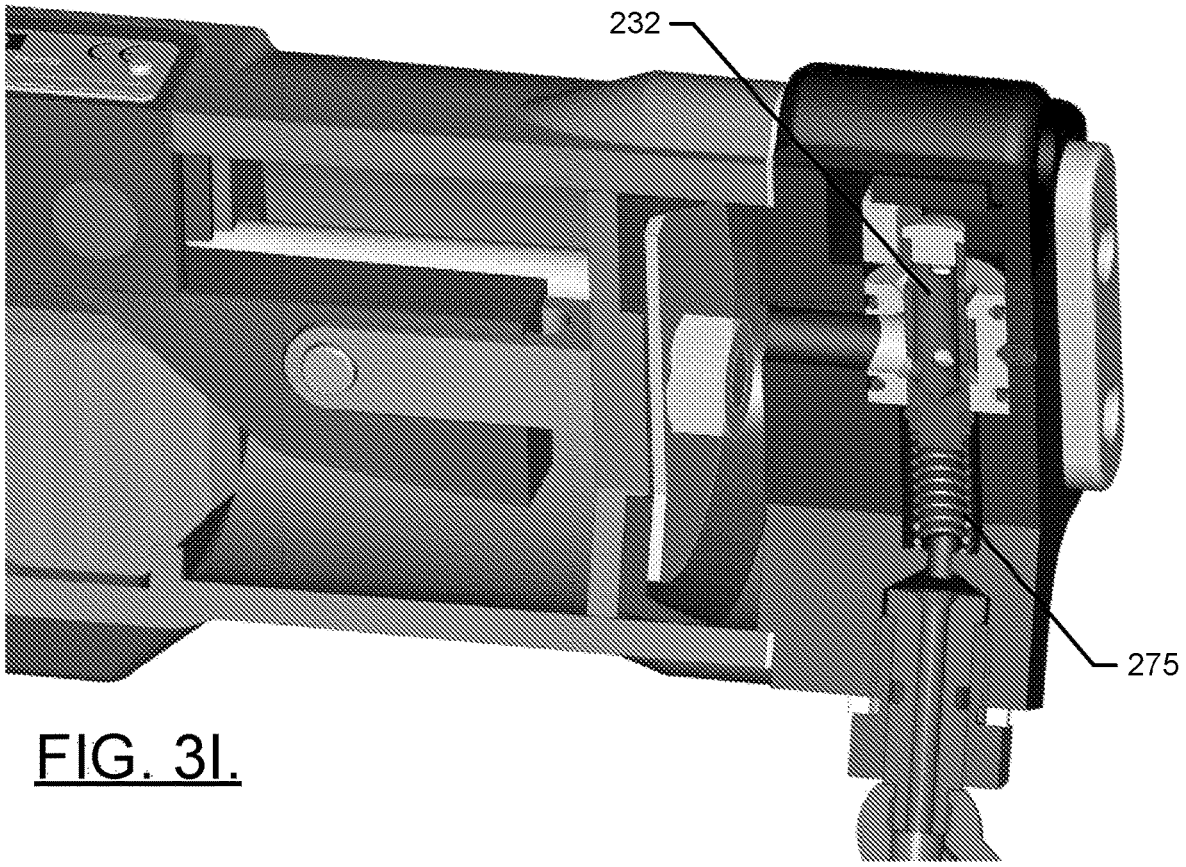

The button 242 and the blocking tab 250 are highlighted in context and shown from two different perspectives in FIGS. 3A and 3C, respectively. FIGS. 3E and 3F each show the blocking tab 250 in position to block or prevent the flange 226 from rotating to contact the and displace the piston 232. However, when the button 242 is depressed, the blocking tab 250 may be displaced in the direction of arrow 252 (see FIG. 3F) to create clearance for the flange 226 to rotate and downwardly displace the piston 232. Moreover, after the flange 226 downwardly displaces the piston 232, the flange 226 may also hold the blocking tab 250 out of a blocking position so that subsequent actuations of the lever 220 can occur without corresponding depressing of the button 242. However, if the flange 226 is allowed to return fully out of the way of the blocking tab 250, the blocking tab 250 may move back into a blocking position and further actuation of the lever 220 may only be accomplished by again moving the button 242 to move the blocking tab 250 out of the way of the flange 226.

Accordingly, it should be appreciated that the unlocking assembly 240 may have a locked position and an unlocked position. While the unlocking assembly 240 is in the unlocked position, the blocking tab 250 is moved to allow rotation of the flange 226 to enable the flange 226 to contact the piston 232. Thereafter, the flange 226 is rotatable so that it can be "held" in a holding position from which subsequent actuation of the lever 220 is possible while the flange 226 prevents the blocking tab 250 from moving to place the unlocking assembly 240 in the locked position to enable subsequent operations of the lever 220 without corresponding operation of the button 242. As can be appreciated from FIGS. 1A-3I, the valve assembly portion 230 is covered by a cover 234 (see FIG. 3F) so that the blocking tab 250 is not visible externally. Thus, the blocking tab 250 cannot be intentionally or accidentally broken or removed. As such, the functioning of the safety features associated with the unlocking assembly 240 are protected from accidental or intentional interference.

Thus, during operation, while the operator has positive control of the riveter 200, the operator will push slightly down on the operator portion 222 of the lever 220 to rotate the lever 220 slightly, e.g. a predetermined rotation amount, such as about 15 degrees. Simultaneously (or nearly so), the operator may push inwardly on the button 242 thereby moving the blocking tab 250 in the direction of arrow 252 to permit the flange 226 to contact the piston 232 when the lever 220 is rotated further by the operator. The button 242 can then be released, but the flange 226 will (as long as some small pressure is maintained by the operator) prevent the blocking tab 250 from moving back to the locked position. Rotation of the lever 220 thereafter will actuate the piston 232 progressively to start the riveting cycle and as long as the lever 220 is not completely released, the blocking tab 250 will not return to the locked position. This can allow the operator to initiate a number of sequential riveting operations without operating the button 242 again. If, however, the lever 220 is completely released, a spring 275 provided in the space below the piston 232 will return the piston 232 upward and also return the flange 226 to a position that allows the blocking tab 250 to move back into the position shown in FIG. 3F, e.g. a release position. The spring 275 is shown in the cross section view of FIG. 3I. The button 242 would then need to be actuated again in order to permit further riveting cycles.

The above described unlocking assembly 240 and operation may be referred to as a two-step (2S) design. The operator may perform two steps to unlock the riveter for operation. The first step, e.g. depression of the button 242 may be performed substantially simultaneously with the second step of rotating the lever 222, as discussed above. In some example embodiments other unlocking assemblies may be provided including a three step design (3S), a four step design (4S), or the like, as described below. In an example embodiments, the unlocking assembly 240 may be a modular unit, which may be removed and replaced with other unlocking assemblies, e.g. a three step design or four step design.

Figure 4A:
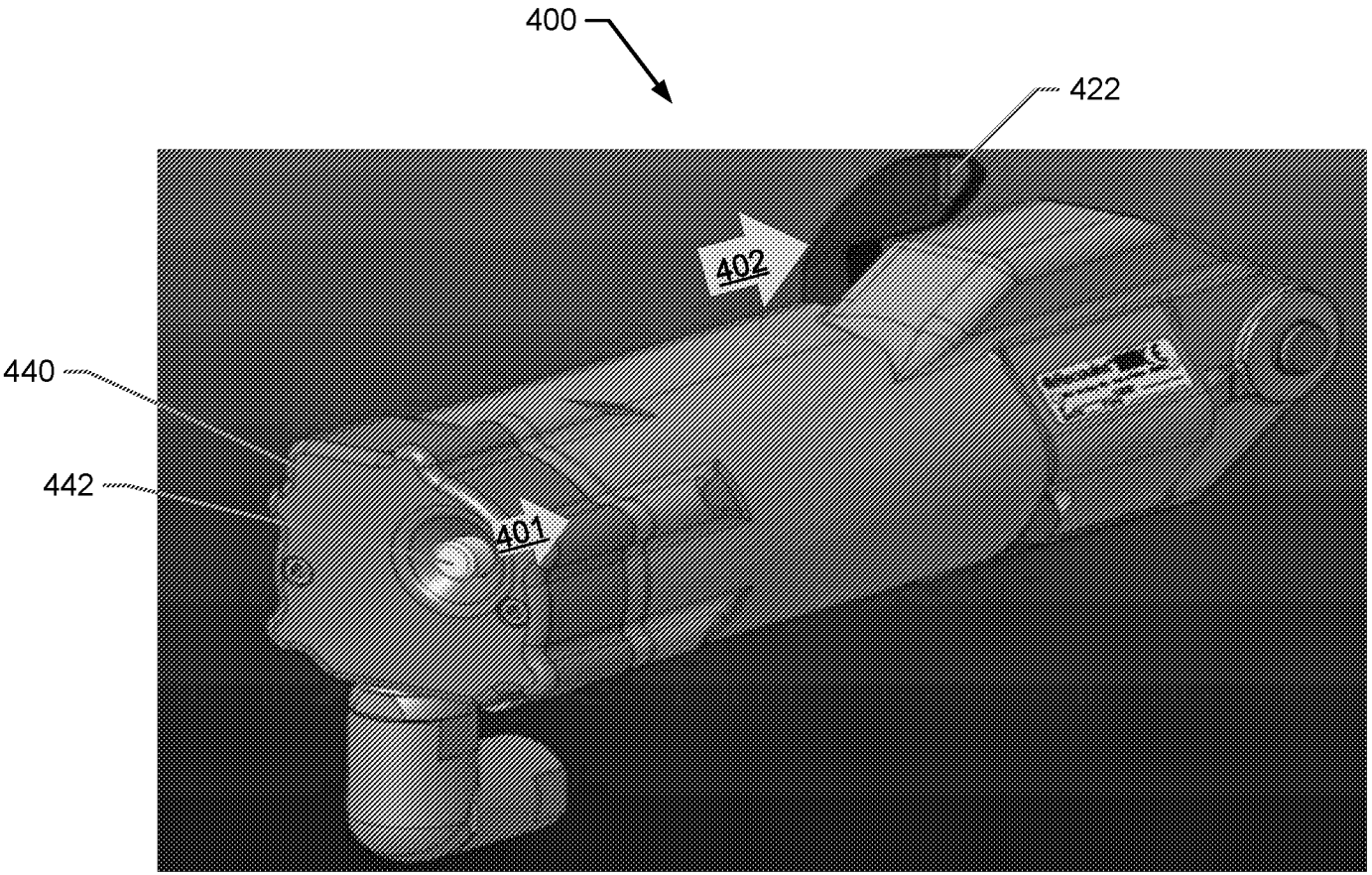
Figure 4B:
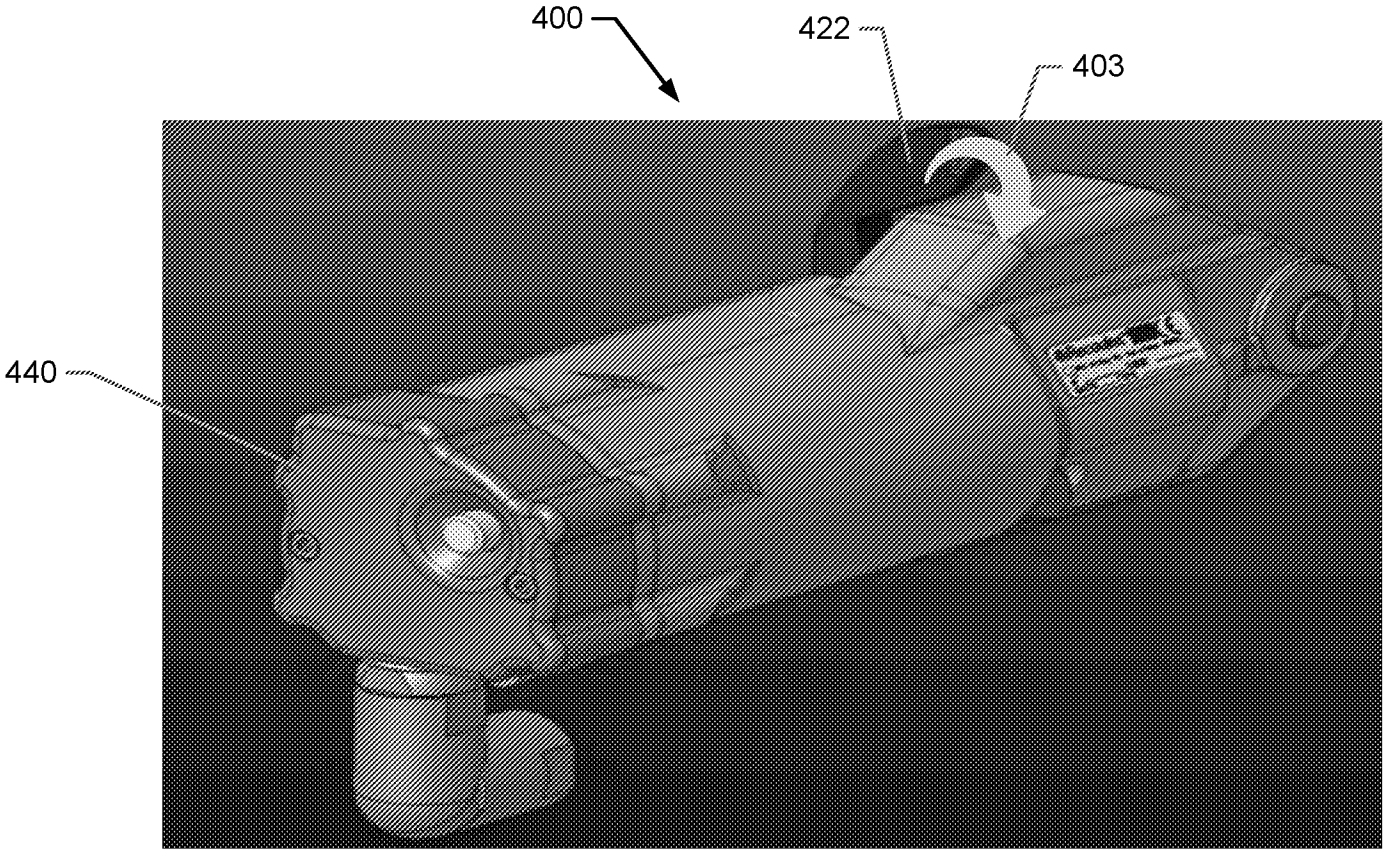

FIG. 4, which includes FIGS. 4A, 4B, 4C, 4D, 4E, 4F, 4G, 4H, and 4I shows views of an example riveter 400 including a three step design unlocking assembly 440 in accordance with an example embodiment. The riveter 400 may operate substantially similar to the riveter 200 described above. FIGS. 4A and 4B illustrate the three step process for unlocking the unlocking assembly 440 to enable riveting operations. In the first step, the operator may depress a button 442 of the unlocking assembly 440 in a direction of longitudinal extension of the riveter 400, as depicted by arrow 401. The second step may be performed during, or substantially simultaneously with, the first step and may include translating the operator portion 422 of lever 420, depicted in FIG. 4I, forwardly in a longitudinal direction of extension of the riveter 400 along an axis defined by the lever arm 424, as depicted by arrow 402. The third step may include rotating the operator portion 422 of the lever 420 at least a predetermined amount, such as 15 degrees. At the completion of step three, the operator may depress, e.g. rotate an additional amount, the operator portion 442 of the lever 420 to initiate rivet driving as depicted by arrow 403. Similar to the two step design, the unlocking assembly 440 may enable subsequent operations of the lever 420 while a pressure is maintained on the lever 420, e.g. the lever 420 is maintained at least the predetermined amount of rotation, e.g. in a holding position. The internal operation of the three step unlocking assembly is discussed in reference to FIGS. 4C-4F below.

Figure 4D:
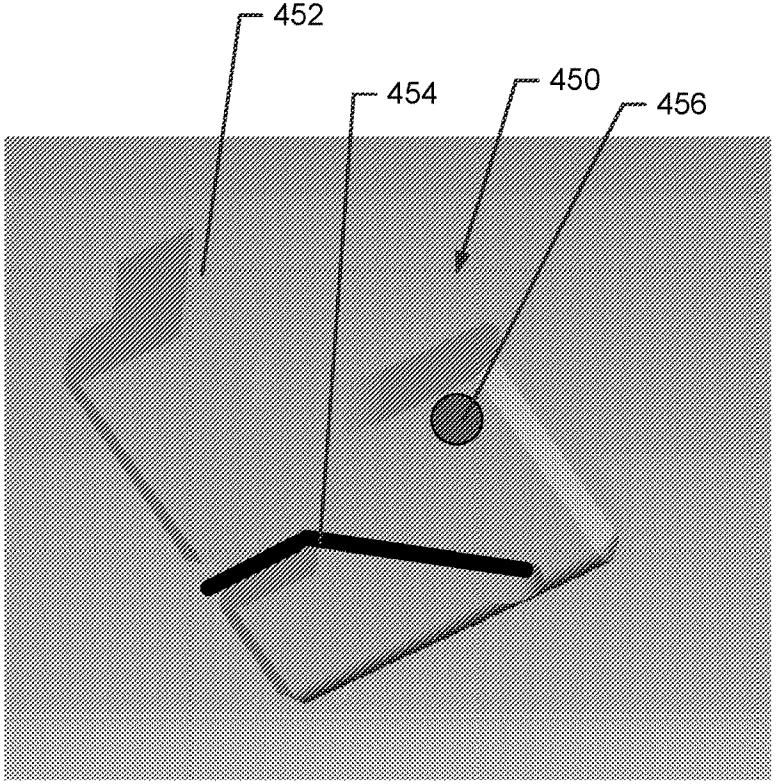
Figure 4C:
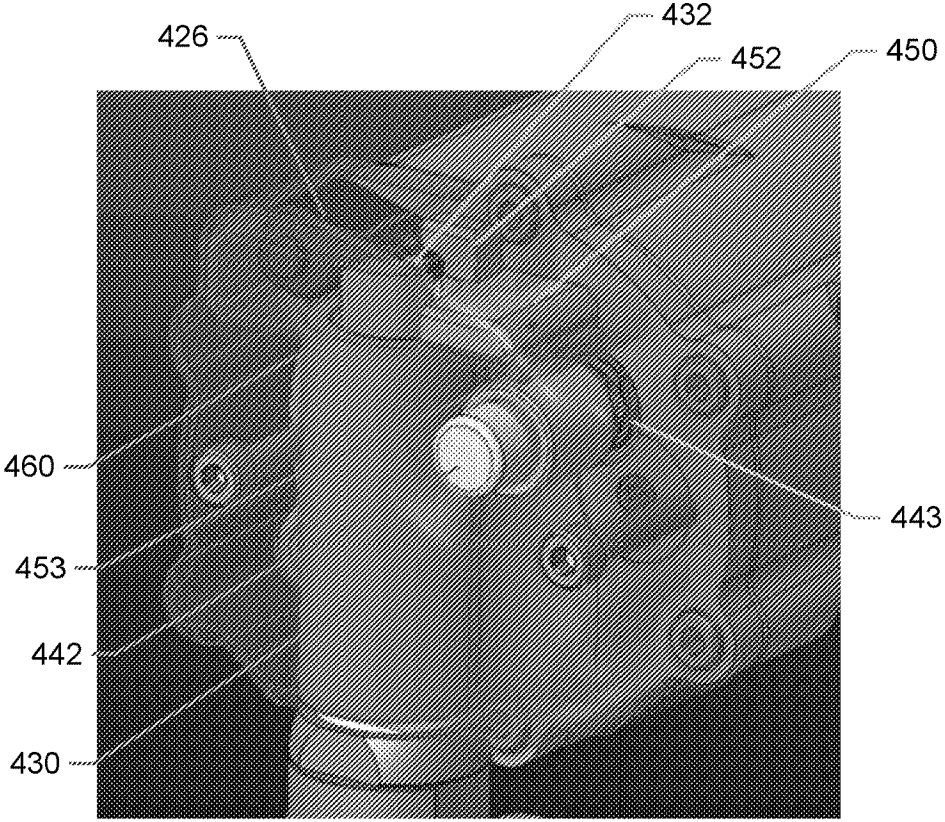

FIG. 4C illustrates a perspective view of the unlocking assembly 440 with a transparent casing to aid in understanding of the arrangement of the internal components. The unlocking assembly 440 may include the button 442, which may extend from the unlocking assembly 440, such that the button 442 is accessible to an operator. The button 442 may include a biasing element, such as a coil spring 443, configured to bias the button toward a blocking position associated with the locked position of the unlocking assembly 440.

The button 442 may be operably coupled to a blocking tab 450 configured to prevent a flange 426 from actuating a piston 432 to actuate a valve assembly portion 430, which in turn initiates rivet driving. As illustrated in FIG. 4D, the blocking tab 450 may include a vertical extention 452 configured to be disposed between the flange 426 and the piston 432 to prevent the flange 426 from rotating to engage the piston 432. The blocking tab 450 may include a deflection track 454 on a side facing the button 442. The button 442 may include a guide rod 453 configured to translate within the deflection track 454 when the button 442 moves between unlocked and locked positions. The blocking tab 450 may be operably coupled to the valve assembly portion 430, such as by a pivot 456. When the button 442 is depressed by the operator, the guide rod 453 may cause the blocking tab 450 to rotate about the pivot 456, such that the vertical extension 452 is rotated out from between the flange 426 and the piston 432.

In some example embodiments, the unlocking assembly 440 or the valve assembly portion 430 may include a piston blocker 460. The piston blocker 460 may be configured to limit or prevent rotation of the flange 426 when the flange 426 is aligned with the piston blocker 460. In an example embodiment, the piston blocker 460 may be an extension of the valve assembly portion 430 adjacent to the piston 432, as depicted in FIG. 4F.

Figures 4E, 4F:
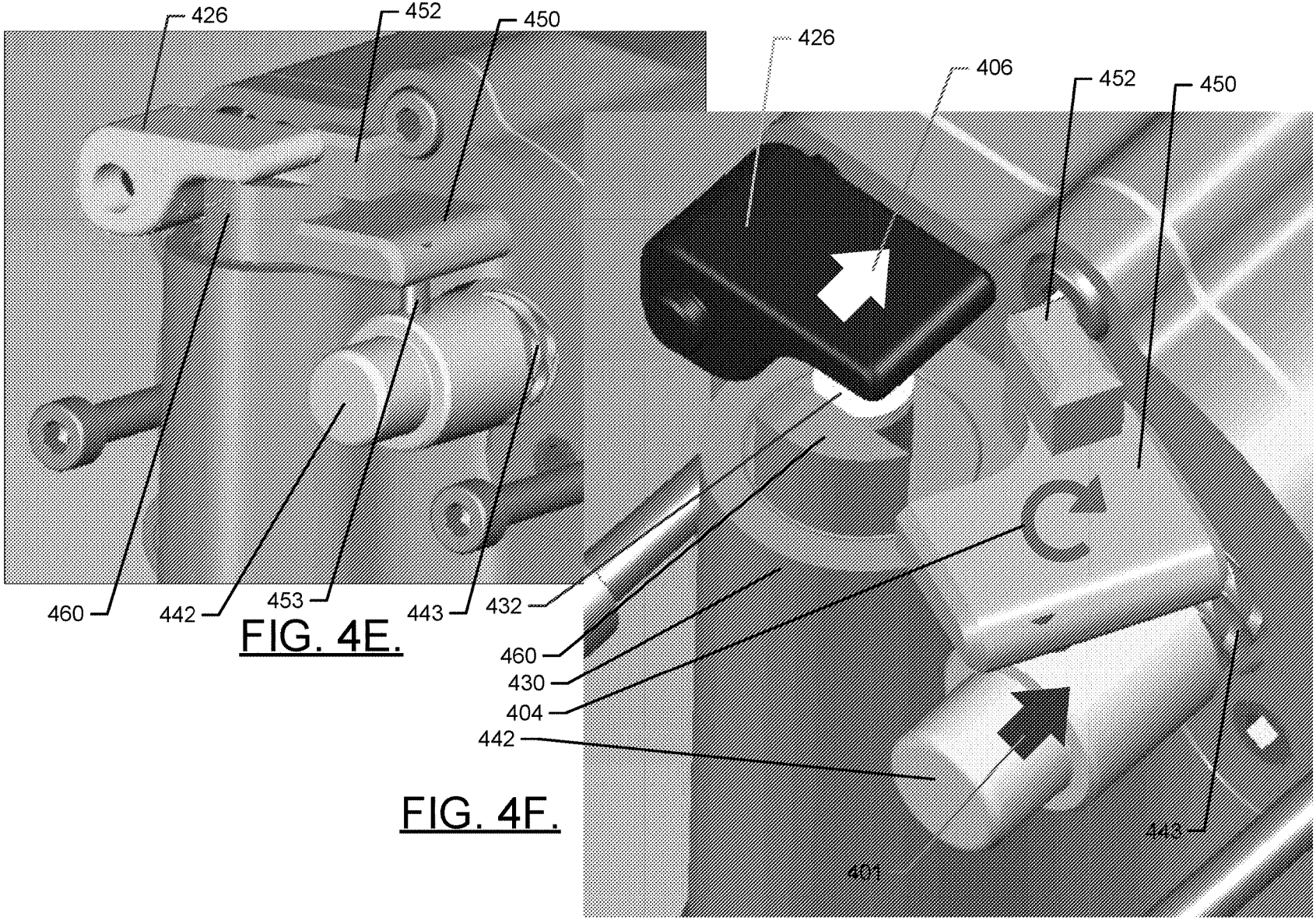

FIG. 4E depicts the internal components of the unlocking assembly 440 in the locked position. The vertical extension 452 of the blocking tab 450 and the piston blocker 460 are positioned to prevent rotation of the flange 426 to actuate the piston 432. FIG. 4F illustrates the movements of the internal components of the unlocking assembly 400 to the unlocked position. The button 442 may be depressed as shown by arrow 401, as discussed in reference to step one. Depression of the button 442 may cause the guide rod 453 to move in the deflection track 454, discussed in reference to FIG. 4D, which in turn causes the blocking tab 450 to rotate relative to the valve assembly portion 430 and/or the flange 426, as depicted by arrow 404. In the deflected position, e.g. the vertical extension 452 is positioned such that the vertical extension 452 does not obstruct the rotation of the flange 426.

Figure 4G:
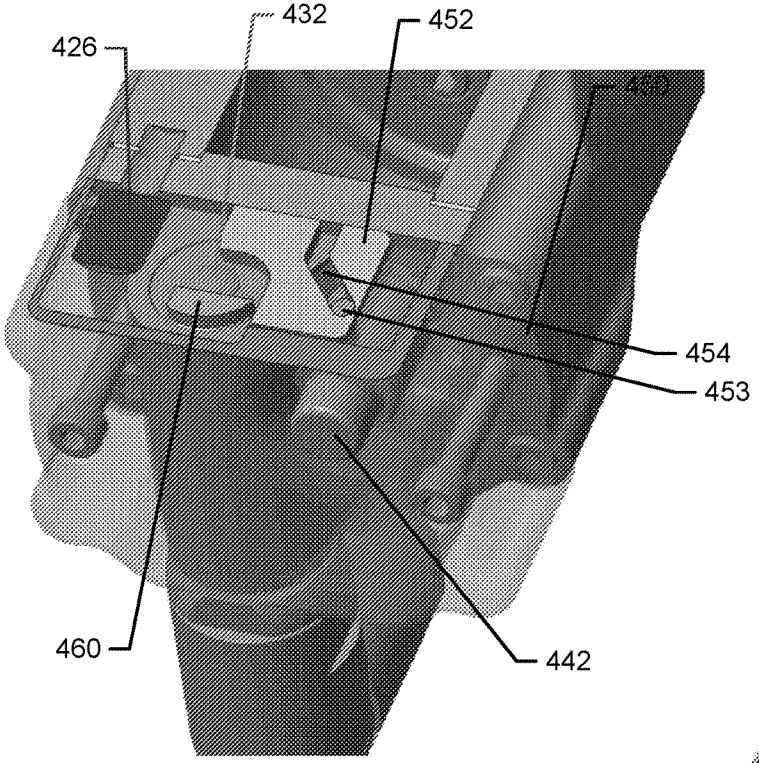
Figure 4H:
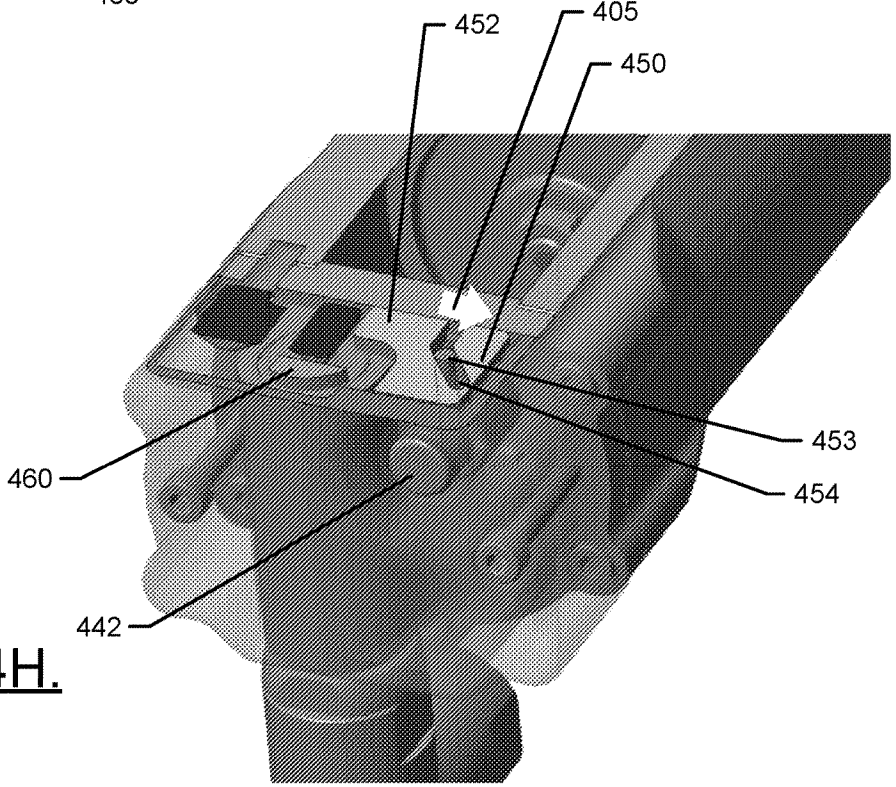

In an alternative embodiment depicted in FIGS. 4G and 4H, the blocking tab 450 may be displaced laterally similar to the blocking tab 250, as discussed above in reference to FIGS. 3A-3I, in response to the guide rod 453 translating within the deflection track 454. Lateral displacement of the blocking tab 450 may move the vertical extension 452 laterally, as depicted by arrow 405, out of the rotation path of the flange 426, such that the flange 426 may actuate the piston 432. In an example embodiment, the casing of the unlocking assembly may restrict the movement of the blocking tab 450 to the lateral deflection path.

During or substantially simultaneously with step one, the operator may perform step two, e.g. translating the operator portion 422 of the lever 420 forwardly, as depicted by arrow 402, in the longitudinal direction of extension. Forward movement of the operator portion 422 of the lever 420 may cause the flange 426 to move forwardly, as depicted by arrow 406, to a permissive position. In an example embodiment, the forward movement of the flange 426 may cause the flange 426 to be positioned such that rotation of the flange 426 will not be obstructed by the piston blocker 460.

Upon completion of step one, rotating the vertical extension 452 of the blocking tab 450, and step two, shifting the position of the flange 426 relative to the piston blocker 460, the operator portion 422 of the lever 420 may be rotated an additional amount, e.g. step three, to actuate the piston 432, thereby initiating rivet driving.

Figure 4I:
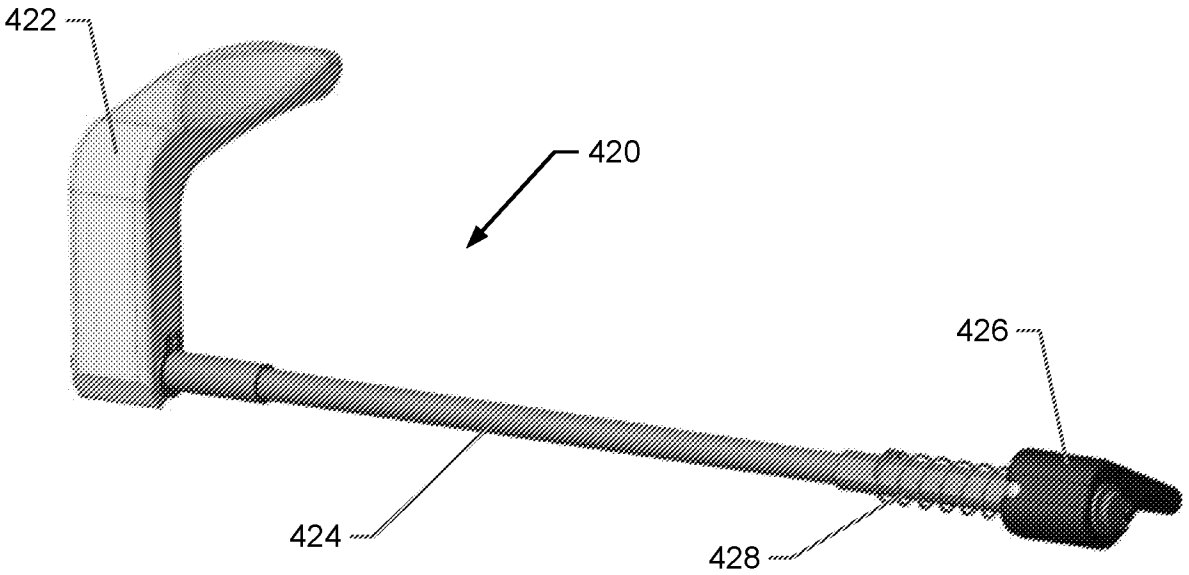

Turning to FIG. 4I, the lever 420 may include the operator portion 422, the lever arm 424, and the flange 426 similar to the lever 220 described above in reference to FIG. 3B. The lever 420 may additionally include a biasing element 428. The biasing element 428 may be configured to bias the lever 420 rearwardly toward the locked position. The valve assembly portion 430 may also include a biasing element, similar to spring 275 discussed above in reference to FIG. 3I, configured to bias the piston 432 toward an unactuated position and thereby cause the flange 426 to be biased toward a non-rotated or release position.

While the flange 426 remains rotated at least the predetermined amount, e.g. about 15 degrees, which as discussed above may be referred to as a holding position, the flange 426 may be prevented from translating backwardly by the piston blocker 460 and may prevent the vertical extension 452 of the blocking tab 450 from rotating between the flange 426 and the piston 432. As such, the subsequent actuation of the lever 420 to depress or actuate the piston 432 may be enabled without corresponding operation of the button 442 or forward translation of the lever 420.

When pressure is released from the operator portion 422 of the lever 420, the lever 420 and therefore the flange 426 may rotate to the release position, allowing the biasing element 443 associated with the button 442 to cause the blocking tab 452 to rotate to the blocking position corresponding to the locked position, as the guide rod 453 translate the deflection guide 454. As discussed above, in the blocking position the vertical extension 452 of the blocking tab 450 may prevent rotation of the flange 426. Additionally, the lever 420 and therefore flange 422 may translate rearwardly to be blocked by the piston blocker 460. FIG. 5 which includes FIGS. 5A, 5B, 5C, 5D, 5E, 5F, 5G, 5H, 5I, 5K, and 5L, shows views of an example riveter 500 with specific components highlighted or isolated to facilitate discussion of the operation of the riveter 500 and a four step unlocking assembly 540 in accordance with an example embodiment. The riveter 500 or may include a lever 520 substantially similar to the lever 420 discussed above in reference to FIG. 4I. The unlocking assembly 540 may be configured for a four step unlocking procedure including manipulation of a button 542 and an operator portion 522 of the lever 520. In an example embodiment, the button 542 may be disposed on a side portion of the unlocking assembly 540, such that the button 542 is operated in a direction perpendicular to a longitudinal direction of extension of the riveter 500.

Figure 5A:
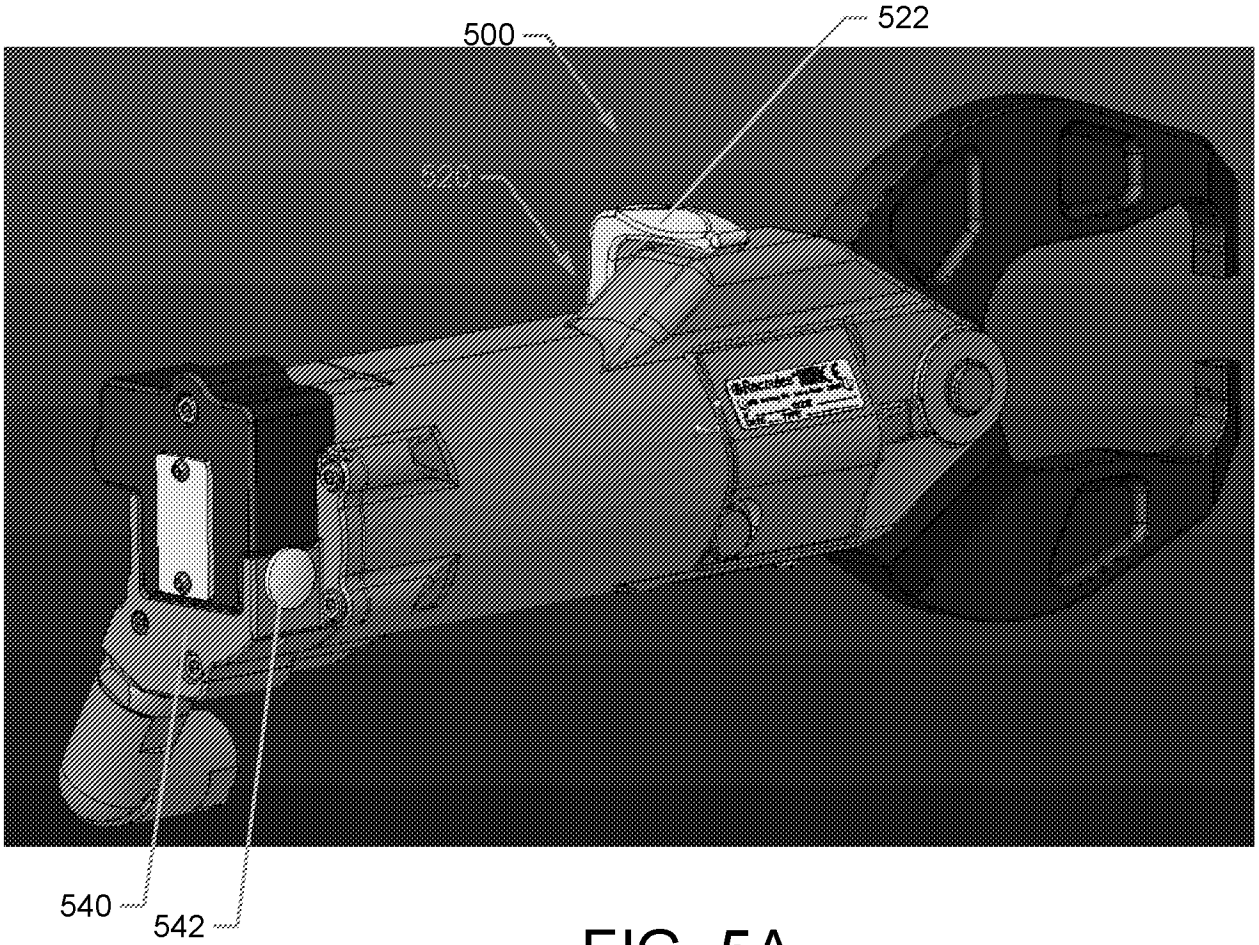
Figure 5C:
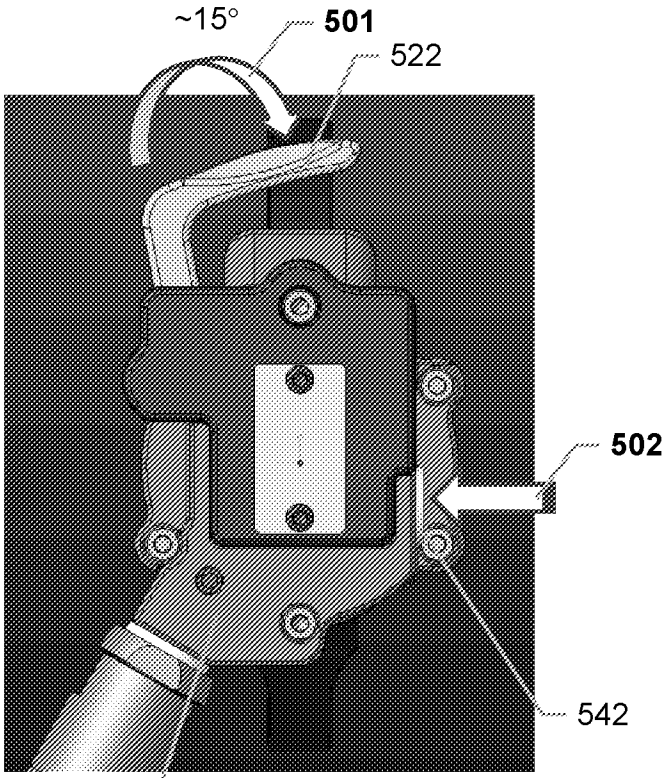
Figure 5B:
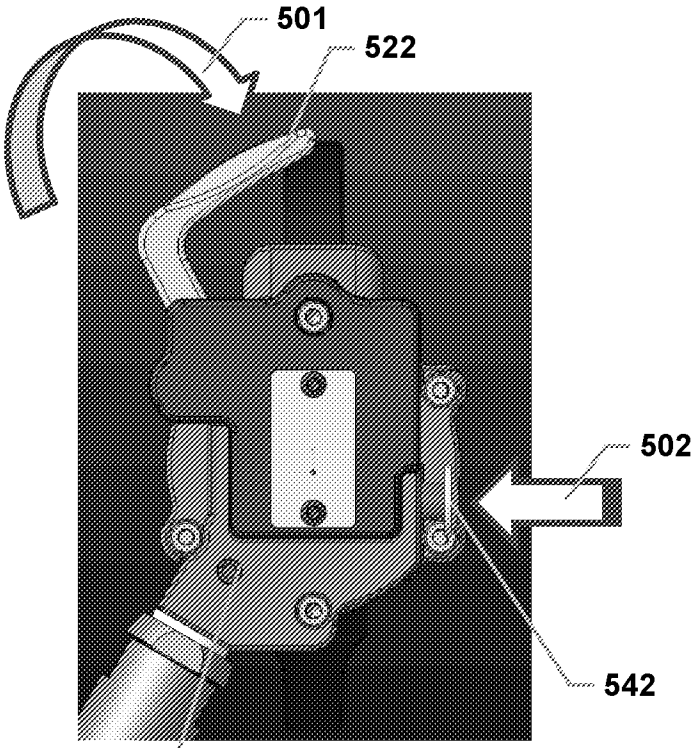
Figure 5D:
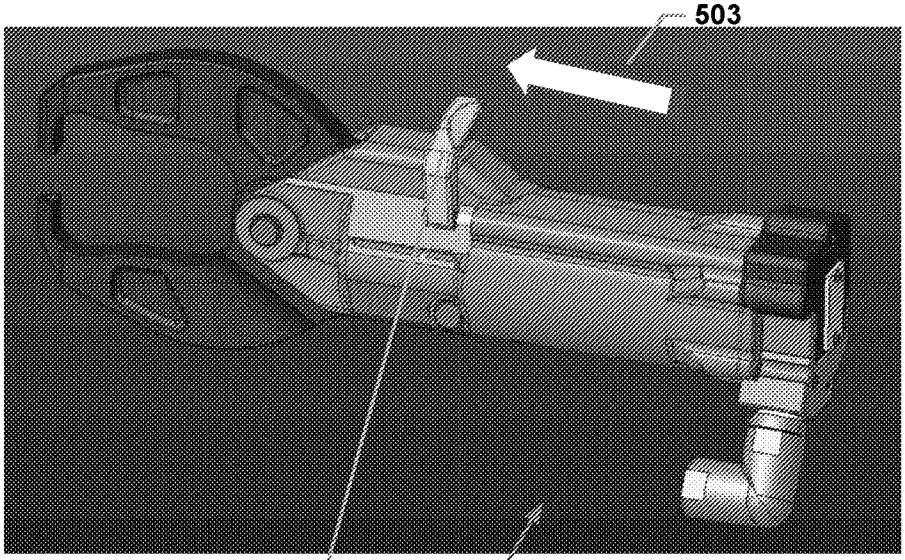
Figure 5E:
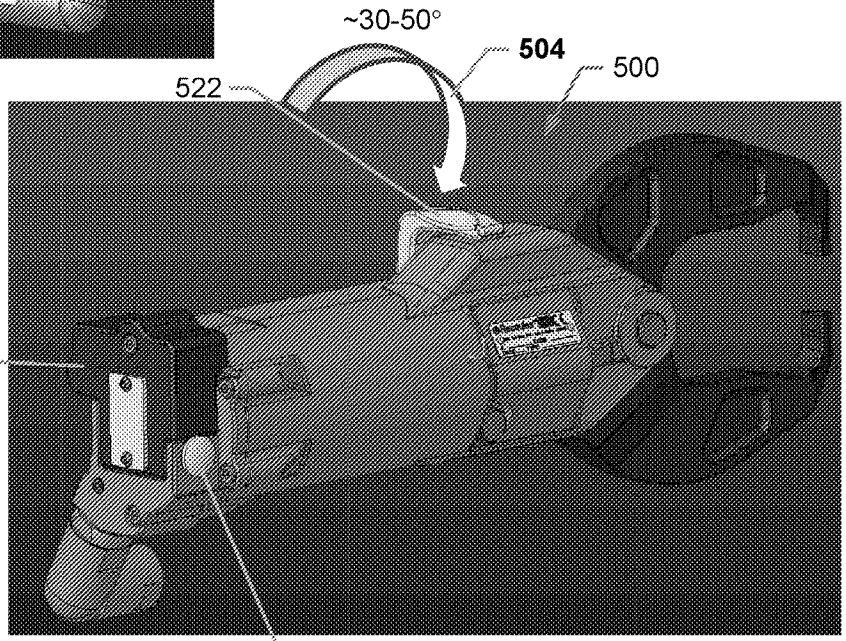

FIGS. 5B and 5C illustrate steps one and two of the four step process to unlock the riveter 500. In step one, the operator portion 522 of the lever 520 is rotated, as depicted by arrow 501, at least a predetermined amount, such as about 15°. Step two may include depressing the button 542 as depicted by arrow 502, during or substantially simultaneously with the rotation of the lever 520 of step one. In step three, the operator portion 522 of the lever 520 may be translated forwardly in a longitudinal direction of extension of the riveter 500, as depicted by arrow 503 in FIG. 5D. The operator portion 522 of the lever 520 may then be rotated an additional amount in step four, such as about 30°, about 50°, or the like, to initiate rivet driving as depicted by arrow 504 in FIG. 5E.

Figure 5F:
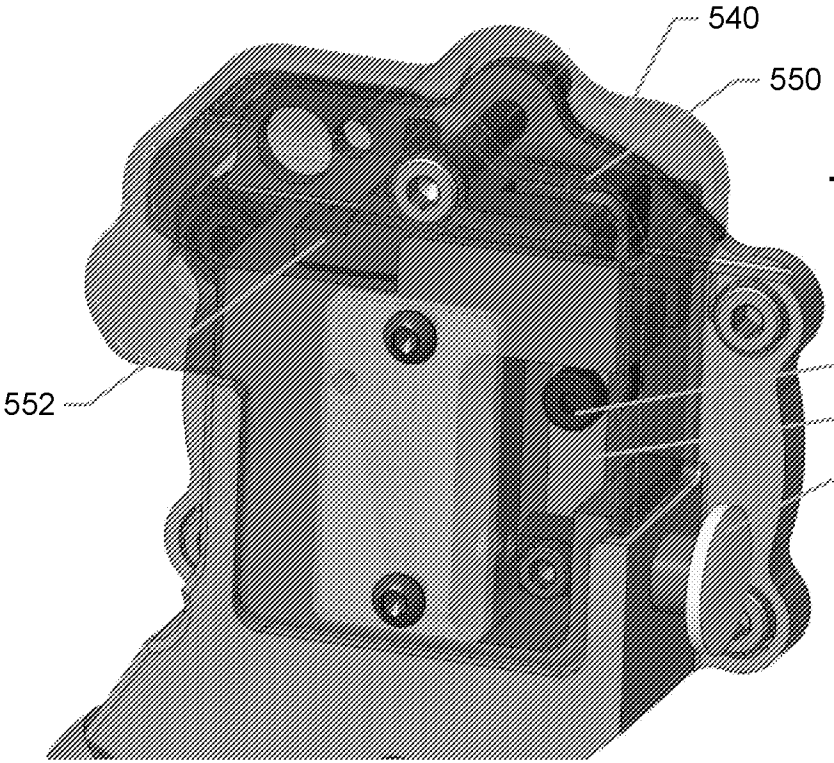
Figure 5G:
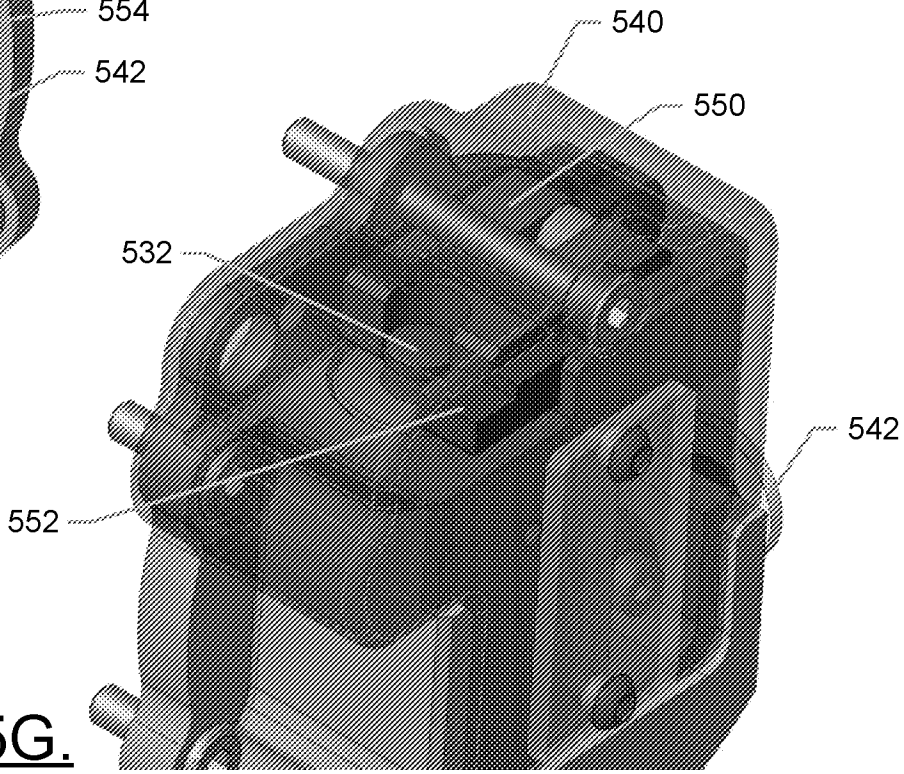
Figure 5H:
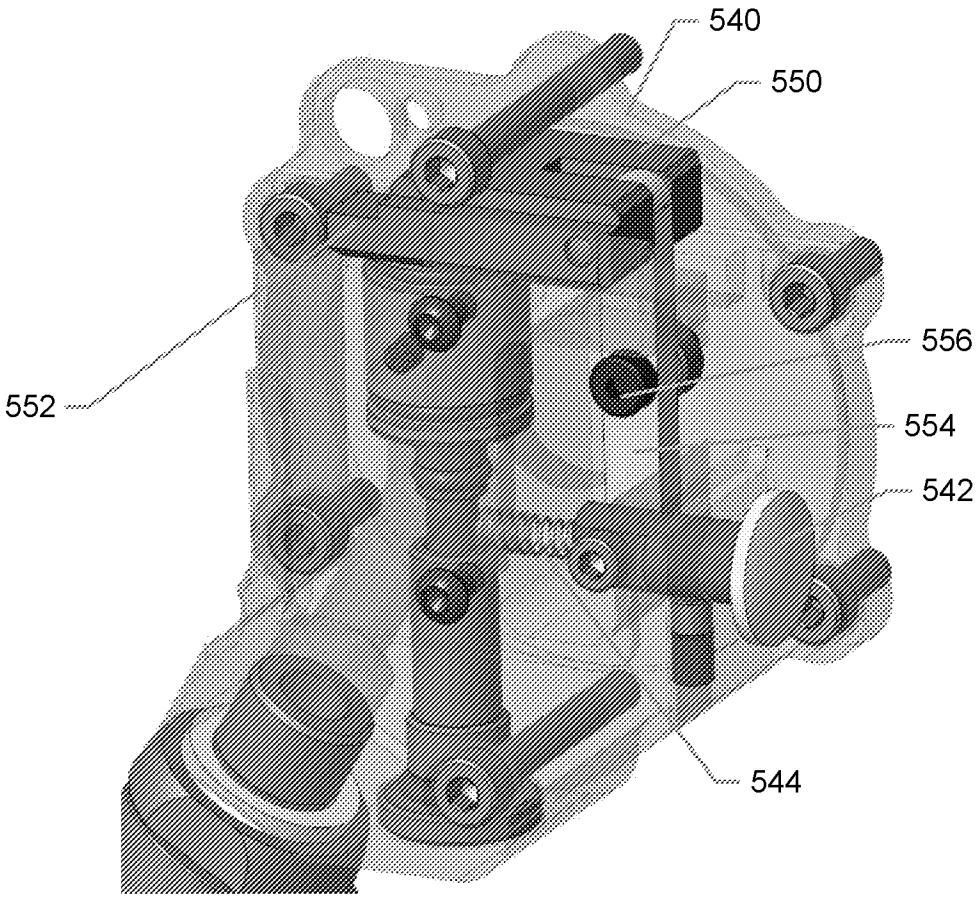

FIGS. 5F-5H depict the internal components of the unlocking assembly 540, with the flange 526 (shown in FIG. 5I) removed for clarity. The unlocking assembly 540 may include the button 542 configured to displace a blocking tab 550. The button 542 may be operably coupled, such as by a rivet, screw, bolt, or the like, to a first end of a pivot cam 554. The blocking tab 550 may be operably coupled, such as by a rivet, bolt, screw, or the like, to a second end of the pivot cam 554. The pivot cam 554 may pivot about a pivot 556, which may be disposed at or near the center of the pivot cam 554.

The button 542 may include or be operably coupled to a biasing element 544, such as a coil spring. The biasing element 544 may be configured to bias the button 542 toward a blocking position corresponding to a locked position of the unlocking assembly 540. The biasing of the button 542 may be translated to the blocking tab 550 through the pivot cam 554, such that the biasing element 544 biases the blocking tab 550 toward the blocking position. The blocking tab 550 may be configured to prevent rotation of the flange 526, in the locked position, as discussed below in reference to FIGS. 5I-5L. The blocking tab 550 includes a blocking projection 552. The blocking projection 560 may prevent rotation of the flange 526 to actuate the piston 532 in a lever lock position. The lever 520 may be translated forwardly in a longitudinal direction of extension of the riveter 500, such as described below in reference to FIGS. 5K and 5L, to a permissive position in which the lever 520 may be rotated to cause the flange 526 to rotate to actuate the piston 532.

Figure 5J:
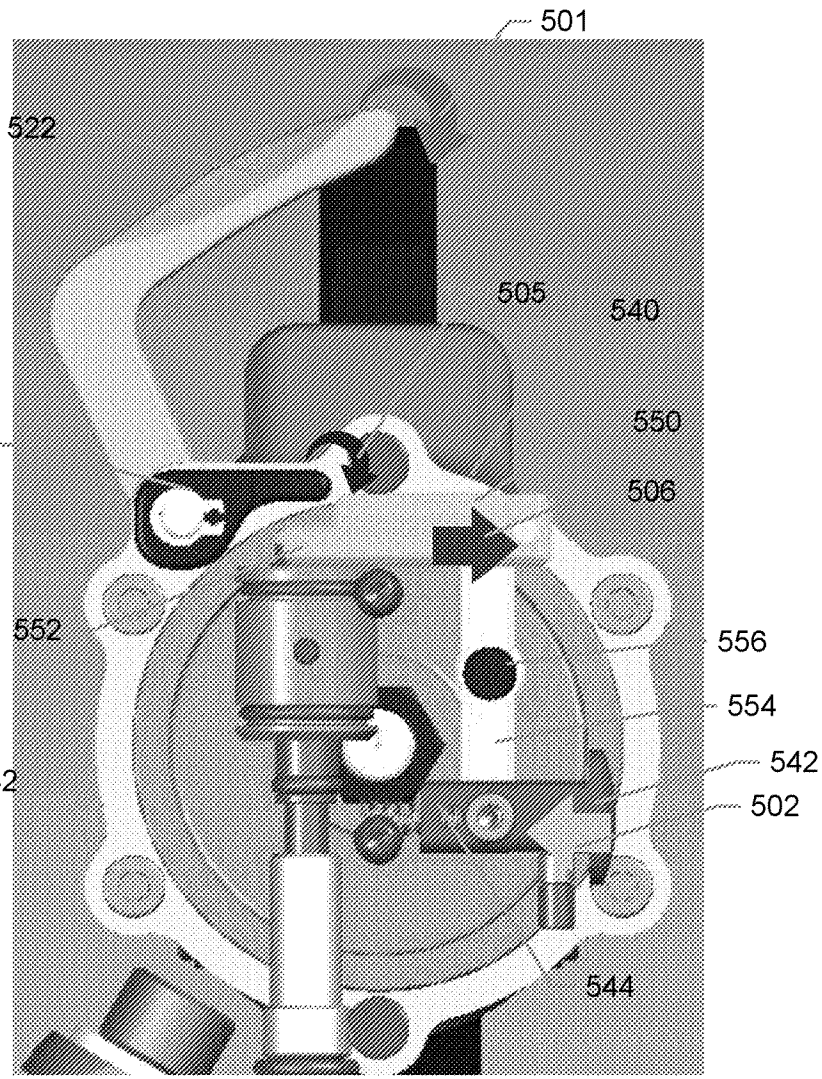
Figure 5I:
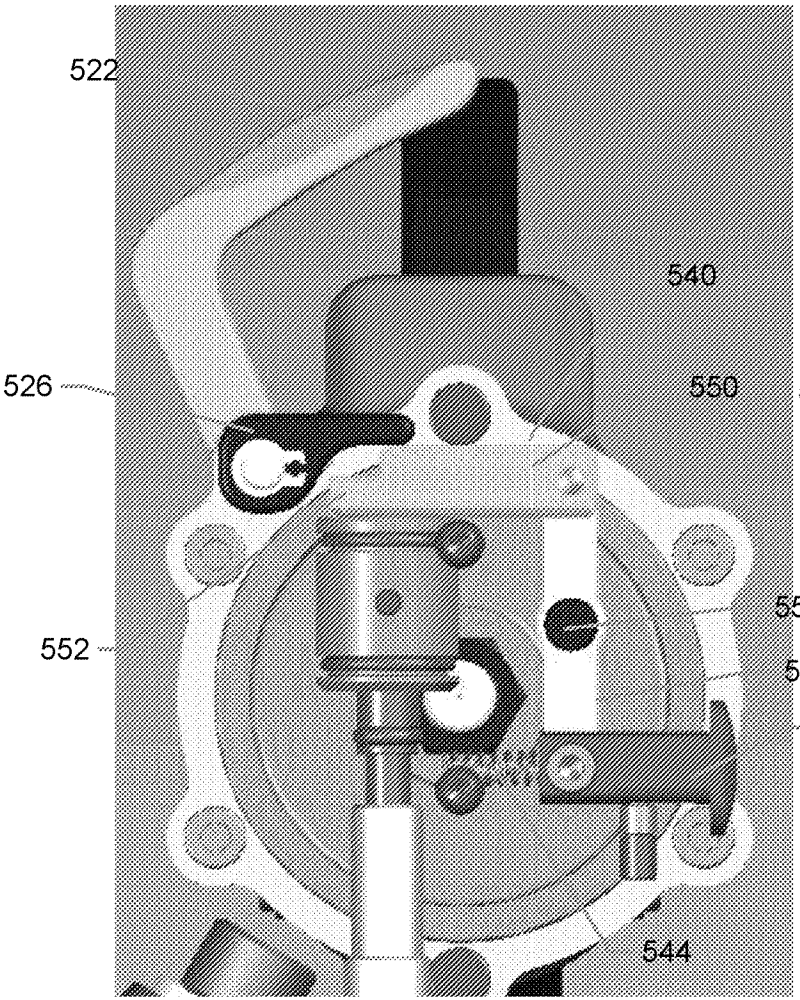

FIGS. 5I-5L depict operations of the above described internal components of the unlocking assembly 540 during the four step unlocking process. FIG. 5I depicted the unlocking assembly 540 in the locked position. In FIG. 5J, the operator portion 522 of the lever 520 is depressed, e.g. rotated in the direction of arrow 501, a predetermined amount, such as about 15°, which causes the flange 526 to rotate as indicated by arrow 505. During the rotation of the operator portion 522 of the lever 520, the button 542 may be depressed as depicted by arrow 502 causing the pivot cam 554 to pivot about pivot 556. The pivoting of the pivot cam 554 may cause the blocking tab 550 to be displaced laterally in a direction opposite of the direction of depression of the button 542, as depicted by arrow 506, such that the blocking tab 550 does not prevent rotation of the flange 526. In the depicted embodiment, which includes a blocking projection 560 the lever may be transitioned to a lever lock position, as described below.

Figure 5L:
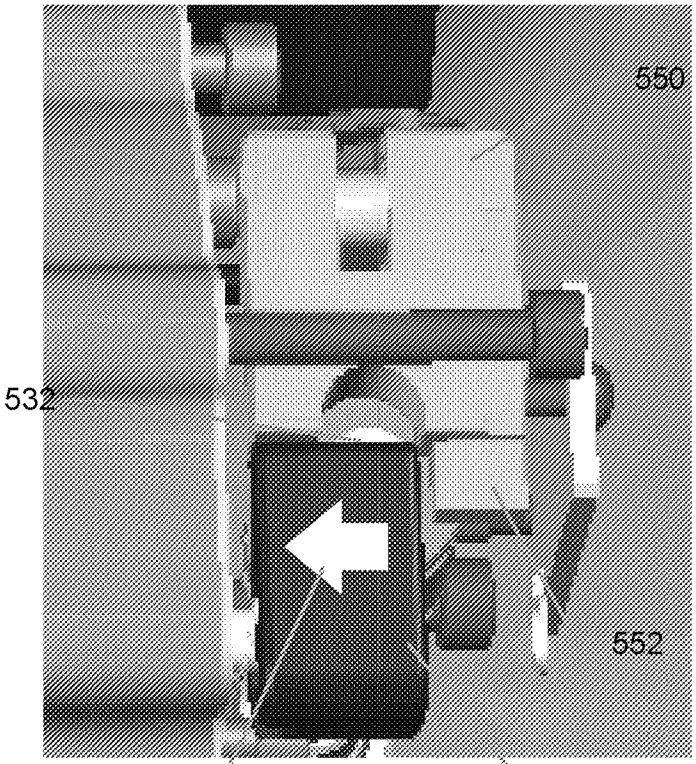
Figure 5K:
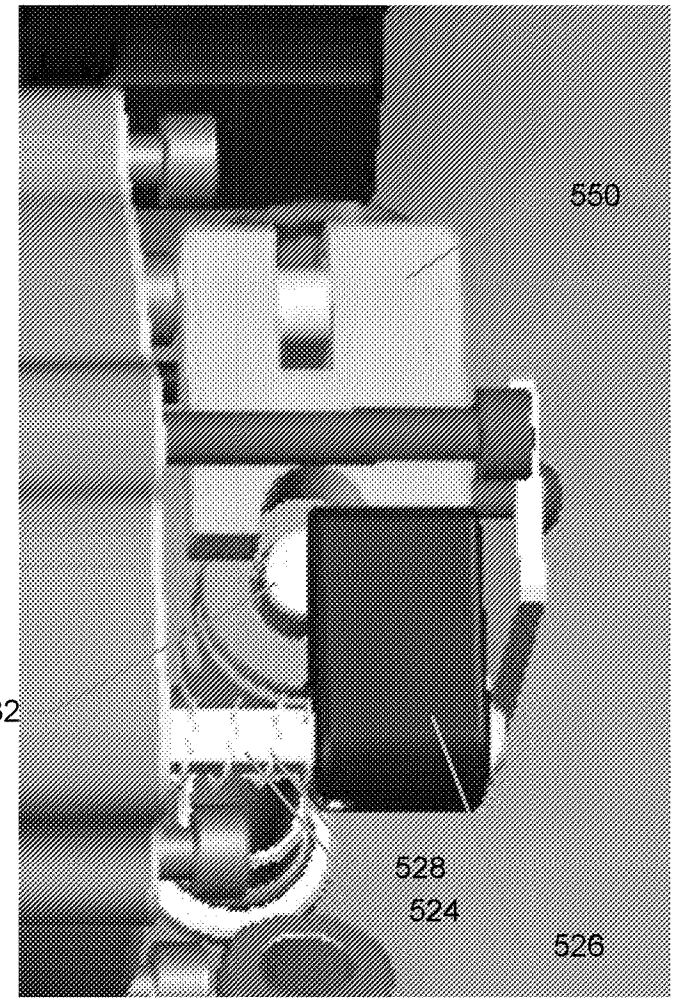

FIGS. 5K and 5L depict step three of the four step process. In FIG. 5K the flange 526 of lever 520 may be blocked from rotation to actuate the piston 526 by the blocking projection 552, e.g. the lever 520 may be in the lever lock position. The lever 520 may be translated forwardly in the longitudinal direction of extension of the riveter 500 from the lever lock position to a permissive position, as depicted by arrow 507 in FIG. 5L. In the permissive position, the flange 526 may be positioned such that the flange 526 may be rotated to actuate the piston 532 to initiate rivet driving, without being obstructed by the blocking tab 550 or the blocking projection 552.

Similar, to the three step design, the lever 520 is biased rearwardly by a biasing element 528 disposed on the lever arm 524. The biasing element 528 may bias the lever 520 toward the lever lock position, in which the blocking projection 552 blocks rotation of the flange 526. As discussed above in reference to FIGS. 5F-5H, the blocking tab 550 may be biased toward the blocking position by the biasing element 544 through the button 542 and pivot cam 554.

The lever 520 may be configured to successively actuate the piston without subsequent operation of the button 542, while a pressure is maintained on the operator portion 522 in a holding position, e.g. the lever 520 is rotated at least the predetermined amount, such as about 15° and the lever 520 is translated forwardly to the permissive position. In the holding position, the flange 526 is rotated at least the predetermined amount preventing the blocking tab 550 from moving to the blocking position. Additionally, the lever 520 may be held in the permissive position by the operator to prevent the lever from translating rearwardly to the lever lock position. In some embodiments, the lever 520 may be translated rearwardly to the lever lock position, and then translated forwardly to the permissive position without the locking assembly 540, e.g. the holding tab 550 moving to the locked position, as long as the lever 520 is maintained rotated at least the predetermined amount.

At the completion of a riveting operation the operator may release the operator portion 522 of the lever enabling the lever 520 to rotate to a release position. The lever 520 may be biased toward the release position, e.g. non-rotated position by a bias element, such a spring substantially similar to spring 275, as discussed above in reference to FIG. 3I. The lever 520 may rotate to the release position allowing the blocking tab 550 to move to the blocking position corresponding to the locked position of the unlocking assembly 540 preventing rotation of the flange 526. Additionally, the lever 520 may translate rearwardly to the lever lock position, as discussed above, such that the four step unlocking process may be repeated to subsequently operate the riveter 500.

In an example embodiment, components may be removed from an unlocking assembly to change the number of steps utilized to unlock a riveter. In an example three step design, as discussed above in reference to FIGS. 4A-4G, the piston blocker 460 or the blocking tab 552 may be removed to shift the unlocking assembly 440 to a two step design, e.g. push button 442 and rotate the lever 420 or forward translate and rotate the lever 420. In another embodiment, the blocking tab 550 depicted in FIGS. 5F-5L may be replaced with a blocking tab 550 that does not include a blocking projection 552, thus shifting the unlocking assembly 540 from a four step unlocking process to a three step unlocking process. Similarly, components may be added to an unlocking assembly, such as the two step design or the three step design, to increase the number of steps utilized to unlock the riveter 200, 300. For example a blocking projection 460 may be added to a valve assembly portion 230, 330 or a blocking projection 552 may be added to a blocking tab to increase the number of steps utilized to unlock the riveter 200, 300.

As discussed above, the unlocking assemblies 240, 440, and 540 may have a modular design, such that the unlocking assemblies 240, 440, and 540, and thereby number of unlocking steps, may be interchangeable based on the safety requirements of the job, site, or operator.

In some example embodiments, a lever of a riveter may be configured for operation by a first hand of an operator and a button may be configured for operation by a second hand of the operator. The lever and the button may be positioned on the riveter to prevent, or discourage, operation of the button and the lever by the same hand of the operator. The two hand operation to unlock the riveter may assist in ensuring positive control of the riveter prior to allowing rivet operations.

In some embodiments, the riveter may be further configured for optional modifications. In this regard, for example, in the unlocked position, a blocking tab of the unlocking assembly is moved to allow rotation of a flange disposed on the lever to enable the flange to contact the piston. In an example embodiment, the flange and the blocking tab are provided within a cover of the valve assembly portion. In some example embodiments, the blocking tab is laterally shifted from a first position to a second position corresponding to the locked position and the unlocked position of the unlocking assembly, respectively. In an example embodiment, the flange is rotatable to a holding position from which subsequent actuation of the lever is possible while the flange prevents the blocking tab from moving to place the unlocking assembly in the locked position to enable subsequent operations of the lever without corresponding operation of the button. In some example embodiments, the lever is biased toward a release position and the blocking tab is biased toward placing the unlocking assembly in the locked position, such that in the absence of pressure on the lever, the lever rotates to the release position enabling the blocking tab to move to place the unlocking assembly in the locked position. In an example embodiment, the blocking tab is rotated about an axis from a first position to a second position corresponding to the locked position and the unlocked position of the unlocking assembly, respectively. In some example embodiments, the flange is translated forwardly to a holding position from which subsequent actuation of the lever is possible while the flange prevents the blocking tab from moving to place the unlocking assembly in the locked position to enable subsequent operations of the lever without corresponding operation of the button. In an example embodiment, the lever is biased toward a release position and the blocking tab is biased toward placing the unlocking assembly in the locked position, such that in the absence of pressure on the lever, the lever rotates to the release position enabling the blocking tab to move to place the unlocking assembly in the locked position. In some example embodiments, the unlocking assembly includes a blocking tab which prevents rotation of a flange to actuate the piston in the locked position. In an example embodiment, the unlocking assembly also includes a pivot cam. The pivot cam includes a first end operably coupled to the button and a second end operably coupled to the blocking tab. The pivot cam is configured to rotate about a pivot disposed between the first end and the second end, such that positioning of the button of the unlocking assembly to the unlocked position causes the blocking tab to allow rotation of a flange disposed on the lever. In some example embodiments, the flange is rotatable to a holding position in which the flange prevents the blocking tab from moving to place the unlocking assembly in the locked position. In an example embodiment, the flange is rotated about 15 degrees to the holding position. In some example embodiments, the blocking tab includes a blocking projection preventing actuation of the valve in a lever lock position. The lever is configured to be translated forwardly in a longitudinal direction of extension of the pneumatic riveter from a lever lock position to a permissive position from which subsequent actuation of the lever causes the flange to contact the piston. In an example embodiment, the lever is biased toward a release position and the blocking tab is biased toward placing the unlocking assembly in the locked position, such that in the absence of pressure on the lever, the lever translates rearwardly and rotates to the release position enabling the blocking tab to move to place the unlocking assembly in the locked position. In some example embodiments, the unlocking assembly is a modular unit. In an example embodiment, the button is configured to be operated by a first hand of an operator and the lever is configured to be operated by a second hand of the operator and the button and the lever are positioned to prevent operation of both the button and the lever by one hand of the operator. In some example embodiments, the unlocking assembly is disposed on the pneumatic riveter on an end opposite the jaw assembly. In an example embodiment, the lever includes a lever arm. The lever arm is at least partially disposed within a shaft in a body of the pneumatic riveter. In an example embodiment, the button is depressed in a longitudinal direction of extension of the pneumatic riveter or in a direction perpendicular to the longitudinal direction of extension of the pneumatic riveter.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A pneumatic riveter comprising:

a jaw assembly configured to extend around a portion of an object through which a fastener is to be driven;

a lever configured to be actuated to initiate rivet driving, the lever comprising an operator portion, a lever arm, and a flange, the operator portion and the flange being coupled to the lever arm such that actuation of the operator portion by an operator causes the flange to rotate about a longitudinal axis defined by the lever arm;

a valve assembly portion comprising a piston configured to enable progressive control of rivet driving responsive to actuation of the lever; and an unlocking assembly configured to selectively inhibit operation of the lever responsive to positioning of a button of the unlocking assembly in a locked position, and enable operation of the lever responsive to positioning of the button in an unlocked position;

wherein, in the unlocked position, a blocking tab of the unlocking assembly is moved to a position between the operator portion and the flange to create clearance for the flange to contact the piston when the operator portion is actuated; and wherein, in the locked position, the blocking tab is moved to align with the flange to prevent the flange from contacting the piston when the operator portion is actuated.

2. The pneumatic riveter of claim 1, wherein the operator portion is disposed at a front end of the lever arm and the flange is disposed at a rear end of the lever arm.

3. The pneumatic riveter of claim 1, wherein the flange and the blocking tab are provided within a cover of the valve assembly portion.

4. The pneumatic riveter of claim 1, wherein the blocking tab is laterally shifted from a first position to a second position corresponding to the locked position and the unlocked position of the unlocking assembly, respectively.

5. The pneumatic riveter of claim 1, wherein the flange is rotatable to a holding position from which subsequent actuation of the lever is possible while the flange prevents the blocking tab from moving to place the unlocking assembly in the locked position to enable subsequent operations of the lever without corresponding operation of the button; and wherein the lever is biased toward a release position and the blocking tab is biased toward placing the unlocking assembly in the locked position, such that in the absence of pressure on the lever, the lever rotates to the release position enabling the blocking tab to move to place the unlocking assembly in the locked position.

6. The pneumatic riveter of claim 1, wherein the lever is biased toward a release position and the blocking tab is biased toward placing the unlocking assembly in the locked position, such that in the absence of pressure on the lever, the lever rotates to the release position enabling the blocking tab to move to place the unlocking assembly in the locked position.

7. The pneumatic riveter of claim 1, wherein the blocking tab is rotated about the longitudinal axis defined by the lever arm from a first position to a second position corresponding to the locked position and the unlocked position of the unlocking assembly, respectively.

8. The pneumatic riveter of claim 1, wherein the flange forwardly translates to a holding position from which subsequent actuation of the lever is possible while the flange prevents the blocking tab from moving to place the unlocking assembly in the locked position to enable subsequent operations of the lever without corresponding operation of the button.

9. The pneumatic riveter of claim 1, wherein the unlocking assembly is a modular unit.

10. The pneumatic riveter of claim 1, wherein the button is configured to be operated by a first hand of an operator and the lever is configured to be operated by a second hand of the operator and the button and the lever are positioned to prevent operation of both the button and the lever by one hand of the operator.

11. The pneumatic riveter of claim 1, wherein the unlocking assembly is disposed on the pneumatic riveter on an end opposite the jaw assembly.

12. The pneumatic riveter of claim 1, wherein the button is depressible in a longitudinal direction of extension of the pneumatic riveter or is depressible a direction perpendicular to the longitudinal direction of extension of the pneumatic riveter.

13. The pneumatic riveter of claim 1, wherein the operator portion rotates about the longitudinal axis defined by the lever arm in a plane that is perpendicular to a direction that the fastener is driven by the jaw assembly.

14. The pneumatic riveter of claim 1, wherein the flange rotates about the longitudinal axis defined by the lever arm in a plane that is perpendicular to a direction that the fastener is driven by the jaw assembly.

15. The pneumatic riveter of claim 1, wherein the piston actuates in a direction perpendicular to the longitudinal axis defined by the lever arm.

16. A pneumatic riveter comprising:

a jaw assembly configured to extend around a portion of an object through which a fastener is to be driven;

a lever configured to be actuated to initiate rivet driving, the lever comprising a flange;

a valve assembly portion comprising a piston configured to enable progressive control of rivet driving responsive to actuation of the lever; and an unlocking assembly configured to selectively inhibit operation of the lever responsive to positioning of a button of the unlocking assembly in a locked position, and enable operation of the lever responsive to positioning of the button in an unlocked position;

wherein, in the unlocked position, a blocking tab of the unlocking assembly is moved to create clearance for a flange to contact the piston;

wherein, in the locked position, the blocking tab is moved to align with the flange and prevent the flange from contacting the piston; and wherein the unlocking assembly further comprises a pivot cam, wherein the pivot cam comprises a first end operably coupled to the button and a second end operably coupled to the blocking tab, wherein the pivot cam is configured to rotate about a pivot disposed between the first end and the second end, such that positioning of the button of the unlocking assembly to the unlocked position causes the blocking tab to allow rotation of the flange disposed on the lever.

17. The pneumatic riveter of claim 16, wherein the flange is rotatable to a holding position in which the flange prevents the blocking tab from moving to place the unlocking assembly in the locked position.

18. The pneumatic riveter of claim 17, wherein the flange is rotated about 15 degrees to the holding position.

19. The pneumatic riveter of claim 16, where the blocking tab includes a blocking projection preventing actuation of the valve assembly portion in a lever lock position, wherein the lever is configured to be translated forwardly in a longitudinal direction of extension of the pneumatic riveter from the lever lock position to a permissive position from which subsequent actuation of the lever causes the flange to contact the piston.

20. The pneumatic riveter of claim 19, wherein the lever is biased toward a release position and the blocking tab is biased toward placing the unlocking assembly in the locked position, such that in the absence of pressure on the lever, the lever translates backwardly and rotates to the release position enabling the blocking tab to move to place the unlocking assembly in the locked position.

* * * * *